US005692360A

United States Patent [19]

McDonald et al.

[11] Patent Number: 5,692,360

[45] Date of Patent: Dec. 2, 1997

[54] SYSTEM AND METHOD FOR PACKAGING PRODUCTS

[75] Inventors: Gregory E. McDonald; Glenn W. Killinger, both of Simpsonville; John D. Foster, Campobello; Cuong M. Ta, Taylors; Charles C. Zende, Greer; Andrew W. Moehlenbrock, Simpsonville, all of S.C.

[73] Assignee: W. R. Grace & Co.-Conn., Duncan, S.C.

[21] Appl. No.: 547,009

[22] Filed: Oct. 23, 1995

Related U.S. Application Data

[63] Continuation-in-part of Ser. No. 372,088, Jan. 13, 1995, abandoned.

[51] Int. Cl.[6] ..... B65B 31/00

[52] U.S. Cl. ..... 53/434; 53/512

[58] Field of Search ..... 269/236, 303, 269/305, 315; 53/432, 434, 469, 474, 510, 512

[56] References Cited

U.S. PATENT DOCUMENTS

| | | | |
|---|---|---|---|
| 1,974,221 | 9/1934 | Stonehouse | 269/236 |
| 2,901,875 | 9/1959 | Hultkrans et al. | 53/261 |
| 2,946,166 | 7/1960 | Baxter | 53/124 |
| 3,628,302 | 12/1971 | Roberts | 53/59 |
| 3,638,390 | 2/1972 | Kupcikevicius | 53/35 |
| 3,638,394 | 2/1972 | Winokur | 53/255 |
| 3,704,907 | 12/1972 | Gley | 269/236 |
| 3,832,824 | 9/1974 | Burrell | 53/22 |
| 3,864,503 | 2/1975 | Steenolsen | 426/232 |
| 3,879,918 | 4/1975 | Lerner | 53/30 |
| 3,916,600 | 11/1975 | Falt et al. | 53/142 |
| 3,958,391 | 5/1976 | Kujubu | 53/22 |
| 3,965,646 | 6/1976 | Hawkins | 53/512 |
| 3,971,191 | 7/1976 | Hoyland | 53/112 |
| 4,147,012 | 4/1979 | Van Mil | 53/468 |
| 4,172,512 | 10/1979 | Clegg et al. | 198/339 |
| 4,202,153 | 5/1980 | Lerner et al. | 53/459 |
| 4,241,562 | 12/1980 | Meyer | 53/438 |
| 4,267,918 | 5/1981 | Steinbrecher | 198/472 |
| 4,270,336 | 6/1981 | Altenpohl et al. | 53/493 |
| 4,352,263 | 10/1982 | Andrews, Jr. | 53/258 |
| 4,432,188 | 2/1984 | Andrews | 53/436 |
| 4,494,364 | 1/1985 | Meyn | 53/570 |
| 4,499,794 | 2/1985 | Beck et al. | 76/75 |
| 4,510,733 | 4/1985 | Hansen et al. | 53/434 |
| 4,538,399 | 9/1985 | Muller | 53/512 |
| 4,550,548 | 11/1985 | Owensby et al. | 53/512 |
| 4,552,260 | 11/1985 | Teagno et al. | 198/345 |
| 4,553,376 | 11/1985 | Okada et al. | 53/511 |
| 4,580,393 | 4/1986 | Furukawa | 53/512 |
| 4,640,081 | 2/1987 | Kawaguchi et al. | 53/510 |
| 4,754,596 | 7/1988 | Yasumune et al. | 53/434 |
| 4,779,398 | 10/1988 | Glandon et al | 53/512 |
| 4,843,796 | 7/1989 | Furukawa | 53/434 |
| 5,062,252 | 11/1991 | Kupcikevicius | 53/434 |
| 5,095,680 | 3/1992 | Guardiola | 53/244 |
| 5,209,043 | 5/1993 | Kupcikevicius | 53/434 |
| 5,269,216 | 12/1993 | Corominas | 53/510 |
| 5,301,788 | 4/1994 | Hironaka et al. | 198/346 |
| 5,364,084 | 11/1994 | Karash | 269/236 |
| 5,435,114 | 7/1995 | Moehlenbrock et al. | 53/512 |

*Primary Examiner*—Daniel Moon
*Assistant Examiner*—Ed Tolan
*Attorney, Agent, or Firm*—Mark B. Quatt

[57] ABSTRACT

The present invention relates to an apparatus, automated system and method for packaging food products. The system has a novel arrangement for transferring the product from a receiving station to a bagging station which arrangement includes mechanical devices for pulling a bag over the product. The system further includes a unique platen system for transporting the bagged product to various stations where it is vacuumized, sealed, trimmed, and finished. Optionally, the system includes a plurality of needles for injecting a fluid such as a basting fluid into the product.

18 Claims, 32 Drawing Sheets

SYSTEM AND METHOD FOR PACKAGING PRODUCTS

This application is a continuation-in-part of U.S. patent application Ser. No. 08/372,088 filed Jan. 13, 1995 now abandoned.

BACKGROUND OF THE INVENTION

The present invention relates to an system and a method for packaging products, particularly food products such as poultry, cheese, fresh red meat, and smoked and processed meat.

Vacuum packaging in heat sealable plastic bags is a conventional way of packaging food items such as poultry, meat, and cheese. Vacuum packaging typically involves placing the food item in a heat sealable plastic bag and then communicating the bag to a partial vacuum to evacuate air from the bag and collapse it about the food item. The bag is then heat sealed in its evacuated condition so the food item becomes encased in a generally air-free environment.

Apparatus has been developed over the years to partially automate food packaging, e.g as described in U.S. Pat. Nos. 2,901,875 to Hultkrans et al. and 2,946,166 to Baxter. Hultkrans et al. employ an expandable guide assembly mounted on a rigid frame to introduce a poultry product into a bag. Baxter includes a pushing mechanism for pushing the product down the conduit and a fluid operated stop mechanism for abutting against the bagged product.

U.S. Pat. No. 3,628,302 to Roberts relates to a system for classifying products such as food products to be packaged, distributing the classified products to index positions corresponding to their classifications and holding the classified products for packaging. One of the deficiencies of this system is its dependence on operators to perform certain manual steps.

Despite the existence of these packaging machines, there remains a need for a fully automated food packaging system. There also remains a need for a food packaging system which is not labor intensive and which efficiently uses the floor space in food processing and packaging plants.

SUMMARY OF THE INVENTION

In a first aspect, the invention is an apparatus for holding a package which comprises a platen having a first and second lateral half; and a means for clamping the package to the platen, the means comprising a first clamp disposed on the first lateral half of the platen, and a second clamp, discrete from the first clamp, disposed on the second lateral half of the platen, the first and second clamps operable to grasp the package and hold the package on the platen.

In a second aspect, the invention is an apparatus for holding a package which comprises a platen having a first and second lateral half; and a means for clamping the bagged product to the platen, the means comprising a curved clamp disposed on the first lateral half of the platen, the first clamp moveable through a horizontal axis of rotation and operable to grasp the package and hold the package on the platen.

In a third aspect, the invention is a system for holding a package which comprises a platen having a first and second lateral half; a package disposed on the platen; and a means for clamping the package to the platen, the means comprising a first clamp disposed on the first lateral half of the platen, and a second clamp, discrete from the first clamp, disposed on the second lateral half of the platen, the first and second clamps operable to grasp the package and hold the package on the platen.

In a fourth aspect, the invention is a system for holding a package which comprises a platen having a first and second lateral half; a package disposed on the platen; and a means for clamping the package to the platen, the means comprising a curved clamp disposed on the first lateral half of the platen, the first clamp moveable through a horizontal axis of rotation and operable to grasp the package and hold the package on the platen.

In a fifth aspect, the invention is a method for holding a package which comprises providing a platen having a first and second lateral half; placing a package on the platen; providing a means for clamping the package to the platen, the means comprising a first clamp disposed on the first lateral half of the platen, and a second clamp, discrete from the first clamp, disposed on the second lateral half of the platen; and moving the means for clamping such that the clamps grasp the package and hold the package on the platen.

In a sixth aspect, the invention is a method for holding a package which comprises providing a platen having a first and second lateral half; placing a package on the platen; providing a means for clamping the package to the platen, the means comprising a curved clamp disposed on the first lateral half of the platen; and moving the means for clamping such that the curved clamp grasps the package and holds the package on the platen.

In a seventh aspect, the invention is a method for packaging products which comprises transporting a product to a position where a product can be loaded into a bag; loading said product into a bag to form a package; clamping said package to a platen at a first station; moving said platen with said package clamped thereto laterally in a first direction to a vacuum chamber located at a second station; vacuumizing said package in said vacuum chamber to form a first vacuumized package; and sealing said first vacuumized package to form a first sealed package attached to said platen.

In an eighth aspect, the invention is an automated system for packaging a product comprising a station for receiving a product to be bagged; a first station at which said product is bagged; means for positioning a bag having a mouth relative to said first station with the mouth of the bag being open; means for transferring said product from said receiving station to said first station, said transferring means including means for spreading the mouth of said bag, and means for pulling said bag over said product while said product is positioned at said first station; and means for clamping the mouth of the bag, said means comprising a first clamp disposed on the first lateral half of the platen, and a second clamp, discrete from the first clamp, disposed on the second lateral half of the platen, the first and second clamps operable to grasp the package and hold the package on the platen.

For each of the first, third, fifth, seventh, and eighth aspects of the invention, the two clamps are preferably movable or moved toward each other or toward the platen, preferably through a vertical or horizontal axis of rotation, or any angle in between.

For each of the aspects of the invention, preferably a means for accommodating a seal bar is disposed on the platen. This means is preferably a seal seat or indent disposed on or in the platen. A seal bar can optionally be included on the platen.

The seventh aspect of the invention can further comprise moving said first sealed package, disposed on said platen, downwardly to a third station for further processing; transporting said sealed package and said platen from said third station laterally to a fourth station; and releasing said sealed package from said platen at said fourth station.

The seventh aspect of the invention can further comprise returning said platen upwardly to said first station after said releasing step; loading a second product into a second bag to form a second package; clamping said second package to said first platen at said first station; moving said platen with said second package clamped thereto laterally in a second direction opposite to said first direction to a second vacuum chamber located at a fifth station; vacuumizing said package in said second vacuum chamber to form a second vacuumized package; and sealing said second vacuumized package to form a second sealed package attached to said first platen.

The seventh aspect of the invention can further comprise moving said second sealed package, disposed on said platen, downwardly to a sixth station for further processing; transporting said second sealed package and said platen from said sixth station laterally to the fourth station; and releasing said second sealed package from said platen at said fourth station.

In the seventh aspect of the invention, said releasing step preferably comprises ejecting said first sealed package from said platen onto a discharge conveyor.

The seventh aspect of the invention can further comprise weighing said product; determining a quantity of fluid to be injected into said product; and injecting said fluid into said product prior to said product reaching said first station.

In the eighth aspect of the invention, said means for transferring preferably comprises a movable transfer carriage.

In the eighth aspect of the invention, said bag pulling means preferably comprises two spaced apart loading horns mounted to said transfer carriage, said loading horns being inserted into the mouth of said bag as a result of movement of said transfer carriage in a first direction and pulling the bag over the product as a result of the transfer carriage being moved in a direction opposed to said first direction.

Optionally, the eighth aspect further includes means for holding said product at said first station while said bag is being pulled over said product.

In the eighth aspect of the invention, said means for spreading preferably comprises two laterally spaced spreader bars mounted to said transfer means, said spreader bars being movable between a first position spaced from said loading horns to a second position adjacent to said loading horns.

Optionally, the eighth aspect further includes means for opening the mouth of said bag prior to the insertion of said loading horns.

Optionally, the eighth aspect further includes a second station for vacuumizing and sealing said bag surrounding said product, said second station being located at the same elevational level as said first station; and a means for conveying said first platen from said first station to said second station.

Optionally, the eighth aspect further includes a third station for trimming material from said bag surrounding said product, said third station being located at a different elevational level than said fourth station; and a means for conveying said first platen and said bagged product from said second station to said third station.

Optionally, the eighth aspect further includes a fourth station at which said bagged product is released from said first platen, said fourth station being located at the same elevational level as said third station; a means for conveying said first platen and said bagged product from said third station to said fourth station; and a means for ejecting said bagged product from said first platen at said fourth station.

Optionally, the eighth aspect further includes a means for moving said first platen from said fourth station to said first station where a second bagged product is clamped to said platen.

Optionally, the eighth aspect further includes a fifth station for vacuumizing and sealing the bag surrounding the second product, said fifth station being located at the same elevational level as said first and second stations; and a means for conveying said platen with said second bagged product to said fifth station.

Optionally, the eighth aspect further includes a sixth station for finishing said second bagged product, said sixth station being located at the same elevational level as said third and fourth stations; and a means for conveying said first platen with said second bagged product from said fifth station to said sixth station.

Optionally, the eighth aspect further includes a means for conveying said first platen and said second bagged product from said sixth station to said fourth station where said second bagged product is released from said first platen.

Optionally, the eighth aspect further includes a plurality of platens for conveying bagged products from said first station to a plurality of product processing stations, each of said platens being movable through a Figure eight configuration as the bagged products are transported through the product processing stations.

Optionally, the eighth aspect further includes means for weighing said product; means for determining a quantity of fluid to be injected into said product based upon the weight of said product; and means for injecting said fluid into said product after said product has reached said receiving station.

Said product is preferably a poultry product; said fluid to be injected into said product is preferably a basting solution.

Optionally, the eighth aspect further includes a multi-motion actuator means having first means for moving said spreader bars and said loading horns simultaneously in a horizontal direction and a vertical direction, second means for rotating said spreader bars independently of said loading horns about an axis and third means for rotating said loading horns independently of said spreader bars about the axis.

Optionally, the eighth aspect further includes bag clamp means associated with said loading horns for holding a bag on the loading horns.

Other details, objects and advantages of the system and the method of the present invention are set forth in the following description and drawings wherein like reference numerals depict like elements.

BRIEF DESCRIPTION OF THE DRAWINGS

The invention can be further understood by reference to the attached drawings, presented for illustrative purposes, wherein.

DEFINITIONS

"First and second lateral half" as used herein refer to lateral halves of a platen, as determined by considering the centerline of a platen, each half or side of the centerline defining a lateral half. The platen can of course be made from two actual halves which are physically joined together, or by any other suitable combination, but more commonly will be a single plate; thus, "lateral halves" will simply denote relative location of the respective means for clamping.

"Package" is used herein to mean an article inside a thermoplastic container, and will preferably mean a bagged product, especially a food product. Most preferably, it will mean a bagged meat product, such as fresh red meat, where the bag has an open end (bag mouth) which extends beyond the edge of the meat product such that the bag mouth is capable of being sealed by heat or other suitable means to close the bag mouth.

"Indent" is used herein to mean either a recessed portion within the platen, or an aperture in the platen through which a seal seat can move from below the platen.

DESCRIPTION OF THE PREFERRED EMBODIMENT(S)

As previously discussed, the present invention relates to an automated system and method for vacuum packaging products. It has particular utility in packaging food products such as poultry, cheese, fresh red meat and smoked and processed.

Figure 1:
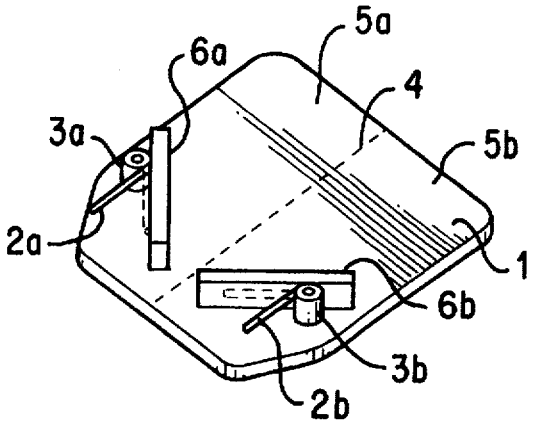
FIGS. 1 and 2 are perspective views of an apparatus for holding a package, in accordance with the present invention.
Figure 2:
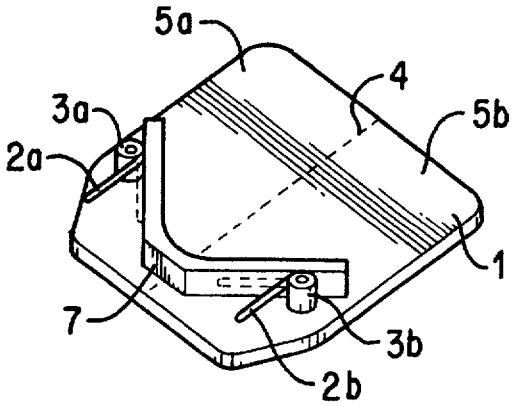

Referring now to FIGS. 1 and 2, these Figures illustrate an apparatus for holding a package. A platen 1 of any suitable construction and material is equipped with a pair of bag neck clamps 2*a* and 2*b*. These pivot about bag neck clamp hinges 3*a* and 3*b* respectively. Centerline 4 defines first and second lateral halves 5*a* and 5*b* respectively. Clamps 2*a* and 2*b* operate to grasp a bag neck, i.e. the edge portion of a filled bag that defines the bag mouth 11. These clamps can close against clamp blocks 6*a* and 6*b* respectively.

FIG. 2 shows a seal seat 7 in lieu of the clamp blocks.

Figure 3:
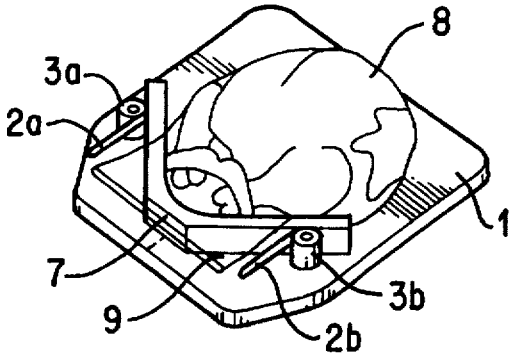
FIGS. 3 and 4 are perspective views of a system for holding a package, in accordance with the present invention.

FIG. 3 shows a bagged product (turkey) 8 with the bag neck clamps in the open position, and the bag neck 9 stretched across the seal seat 7.

Figure 4:
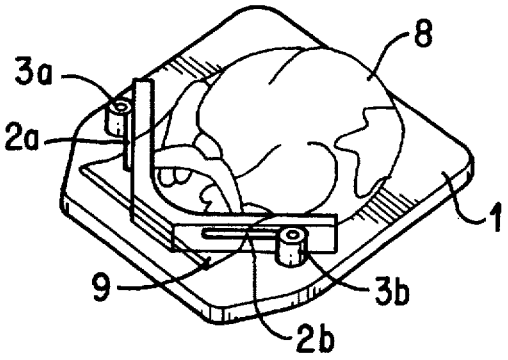

FIG. 4 shows the bag neck clamps in the closed position, holding bag neck 9 securely against seal seat 7.

Figure 5:
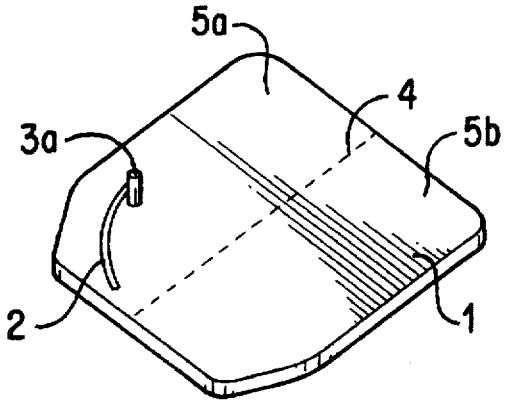
FIGS. 5 to 8 are perspective views of alternate embodiments of an apparatus for holding a package, in accordance with the present invention.

FIG. 5 shows a curved bag neck clamp 2.

Figure 6:
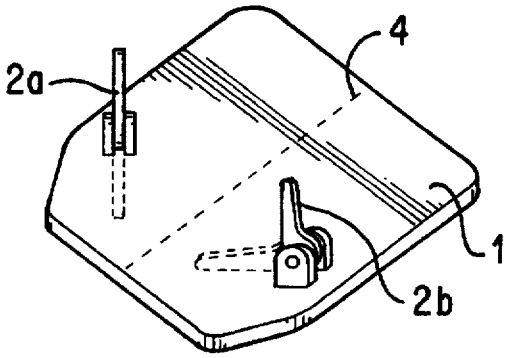
Figure 7:
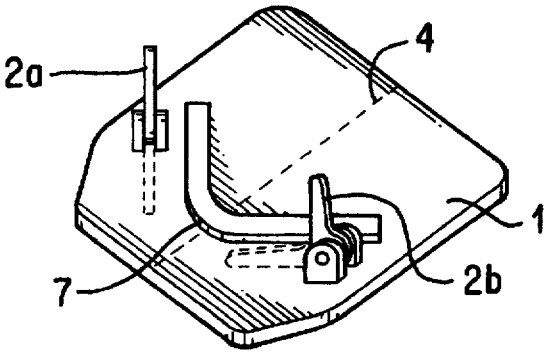
Figure 8:
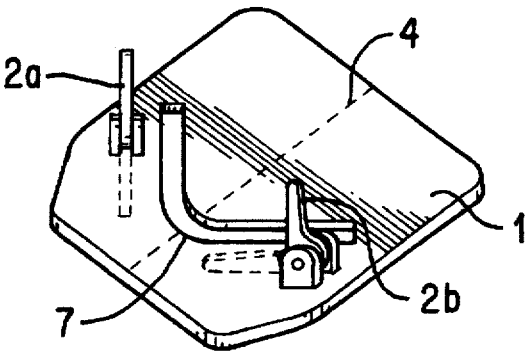

FIGS. 6 to 8 show bag neck clamps 2*a* and 2*b* which move about a horizontal axis. In FIG. 8, an indent 7, having a silicone rubber strip coated with teflon, can accommodate a seal bar (not shown). Alternatively, indent 7 can represent a gap in the platen 1 through which a seal seat can be raised from below the platen.

Figure 9:
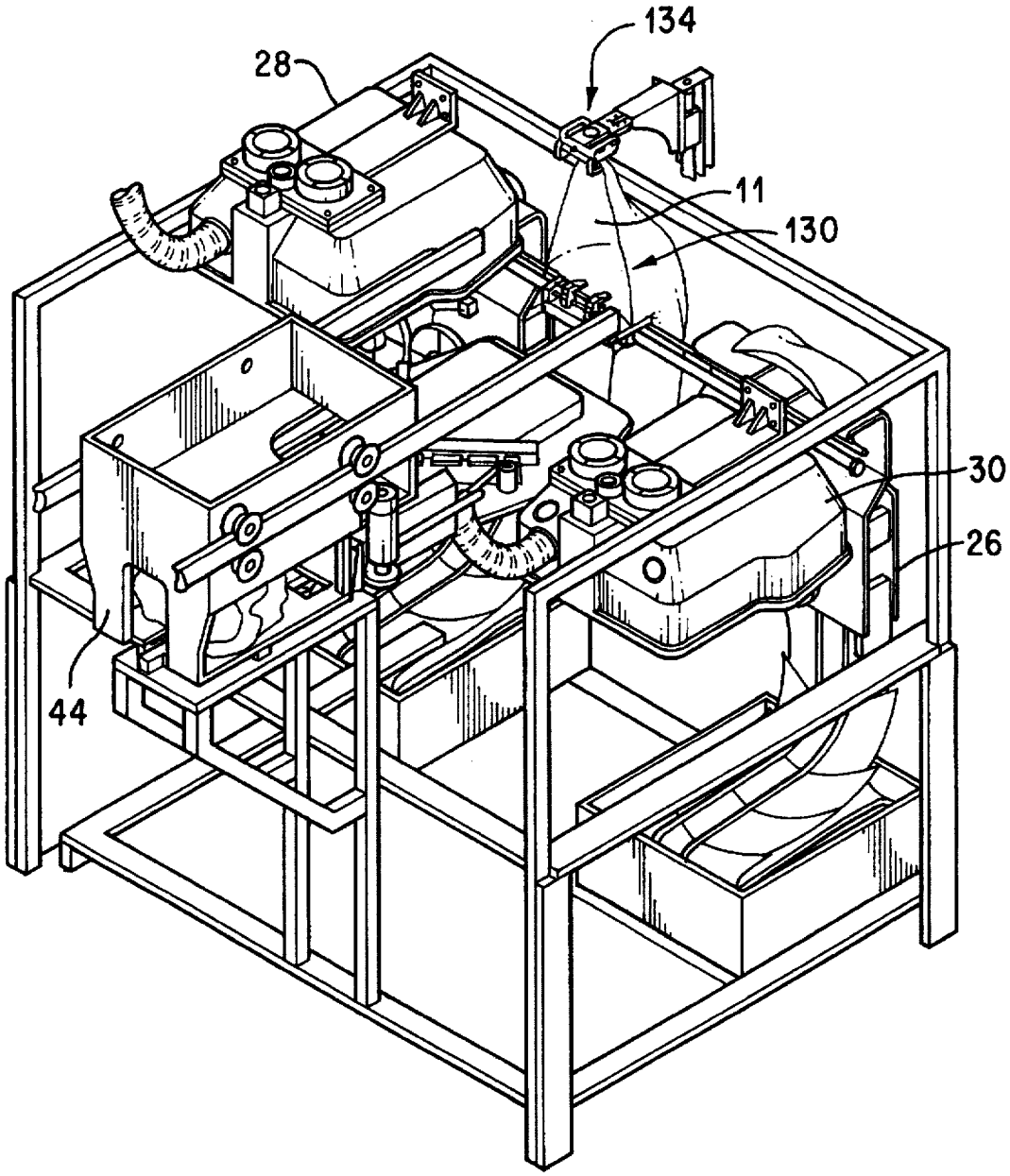
FIG. 9 is a perspective view of the automated system of the present invention.

FIG. 9 is a perspective view of the automated system of the present invention, and shows the general configuration of the automated system.

Figure 10:
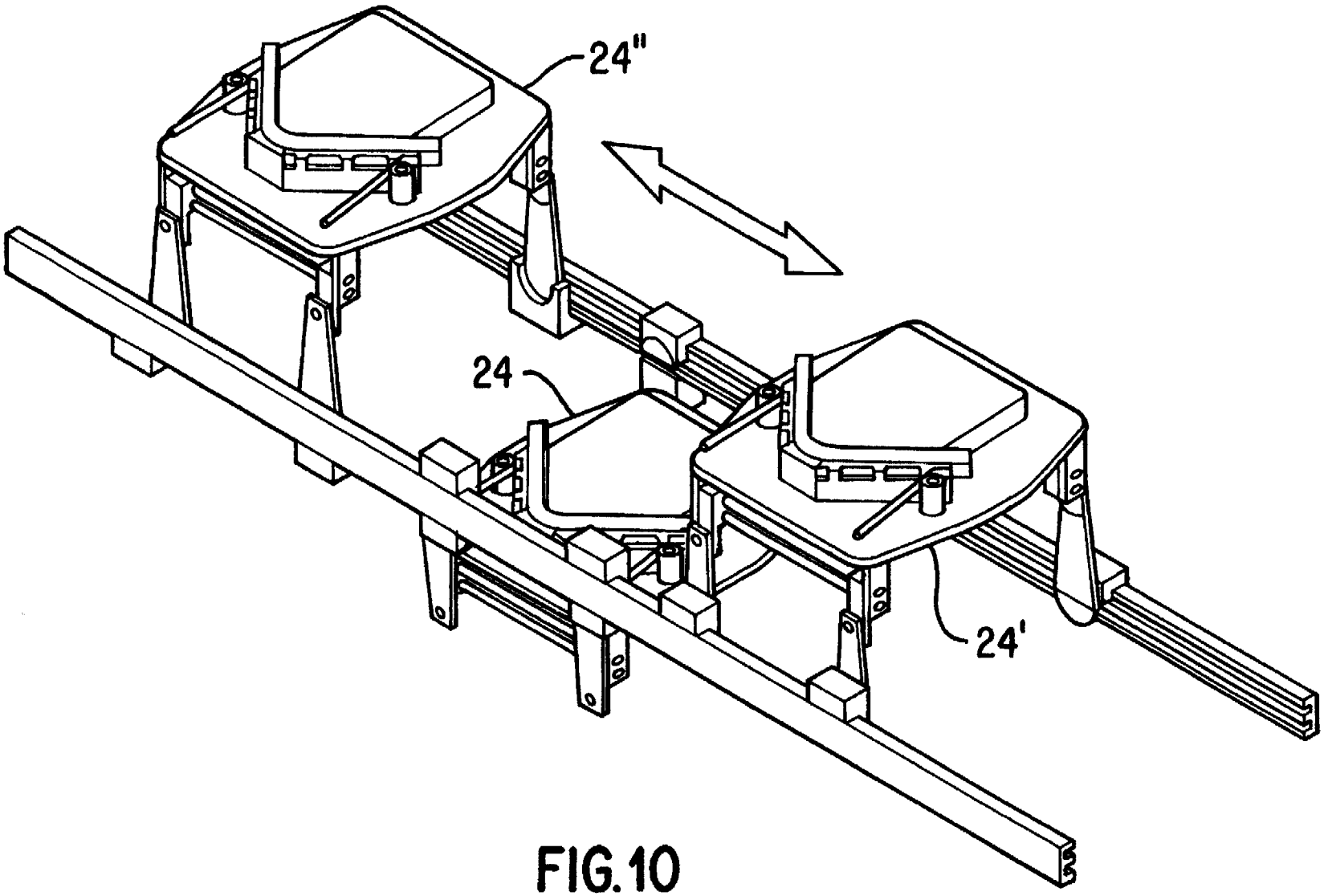
FIG. 10 is a perspective view of the platen assembly of the present invention.

FIG. 10 is a perspective view of the platen assembly of the present invention, showing a central platen 24, a platen 24' to the right of the central platen 24, and a platen 24" to the left of central platen 24.

Figure 11A:
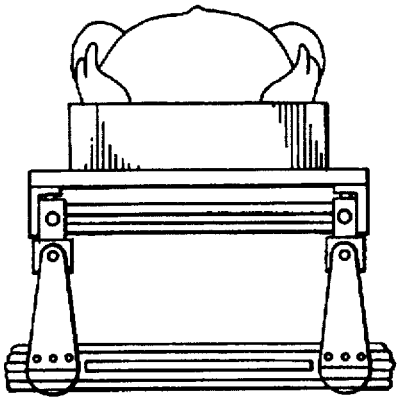
FIGS. 11*a*–11*c* show a platen in the raised, intermediate, and lowered position.
Figure 11B:
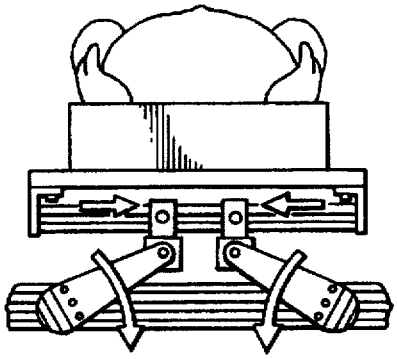
Figure 11C:
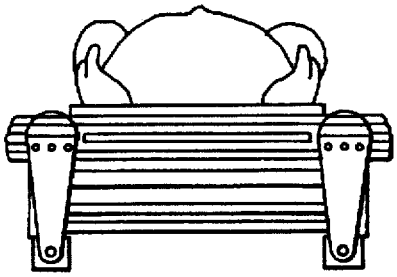

FIGS. 11*a*–11*c* show a platen in the raised, intermediate, and lowered position, in accordance with the operation of the invention.

FIGS. 12 to 33 show the bag loading, indexing, opening and closing system and method of the present invention.

Figure 12:
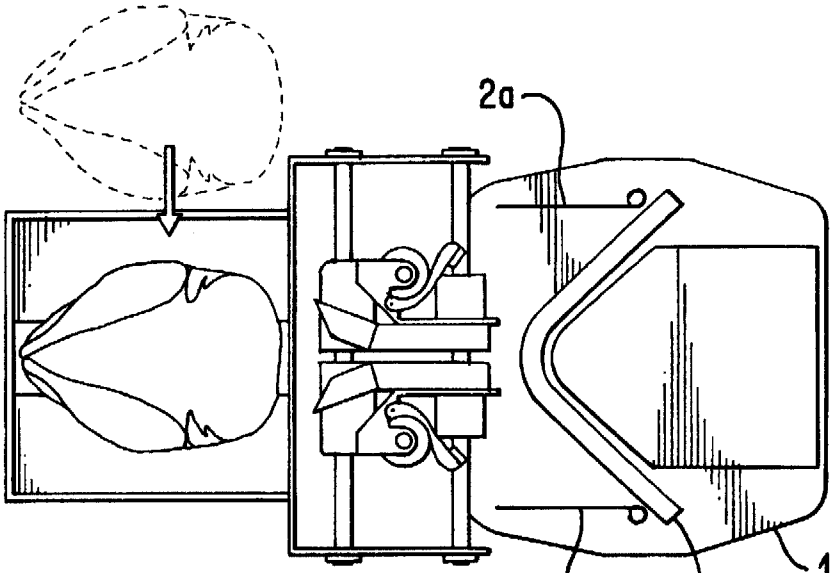
FIG. 12 shows a top plan view of a product being loaded into a receiving station of the present invention.
Figure 13:
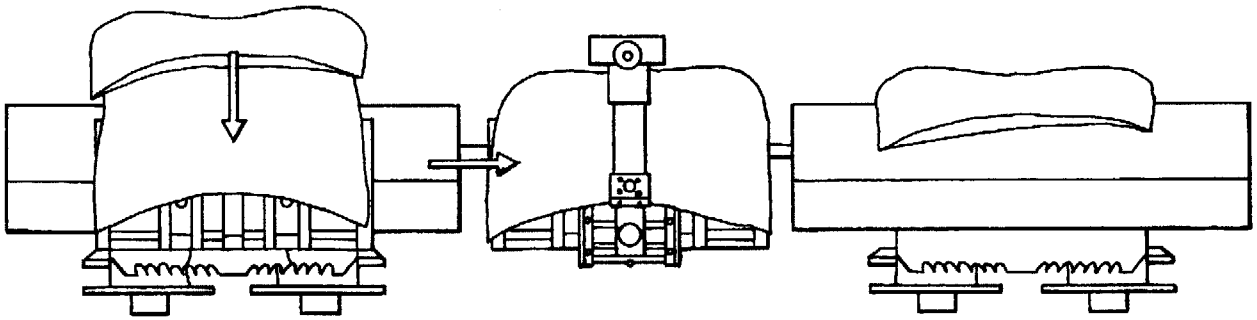
FIG. 13 shows a plan view of the bag indexing system of the present invention.
Figure 14:
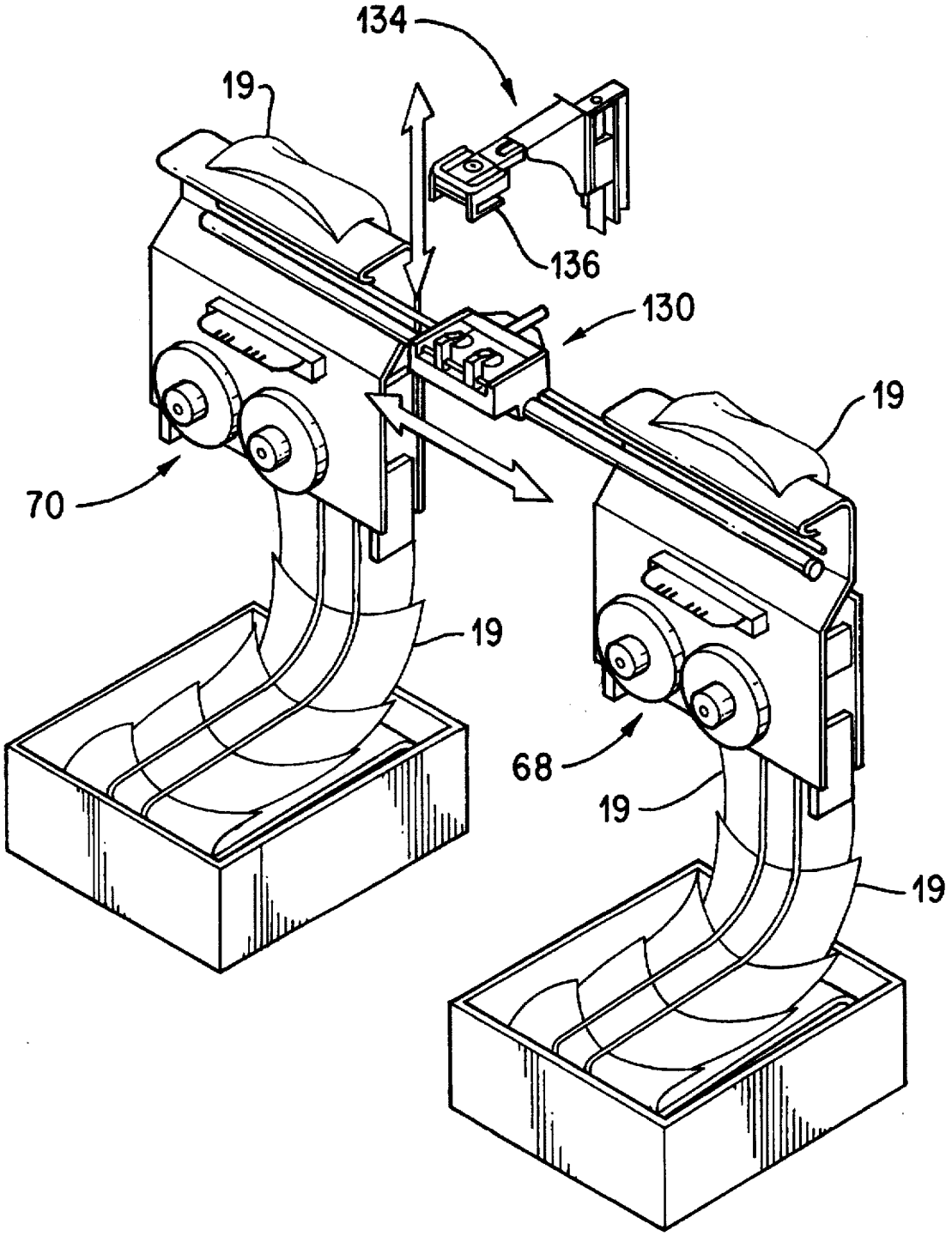
FIG. 14 shows a perspective view of a bag indexer of the present invention.

FIG. 12 shows a top plan view of a poultry product such as turkey 8 being loaded into the receiving station 20. In FIG. 13 shows in a plan view a bag 19 being indexed into the bottom clamp assembly 130 including a bottom clamp 132 (see FIG. 14), and the bag 19 being moved by the bottom clamp assembly into an opening position. FIG. 14 shows a perspective view of the bag indexing system 26.

Figure 15:
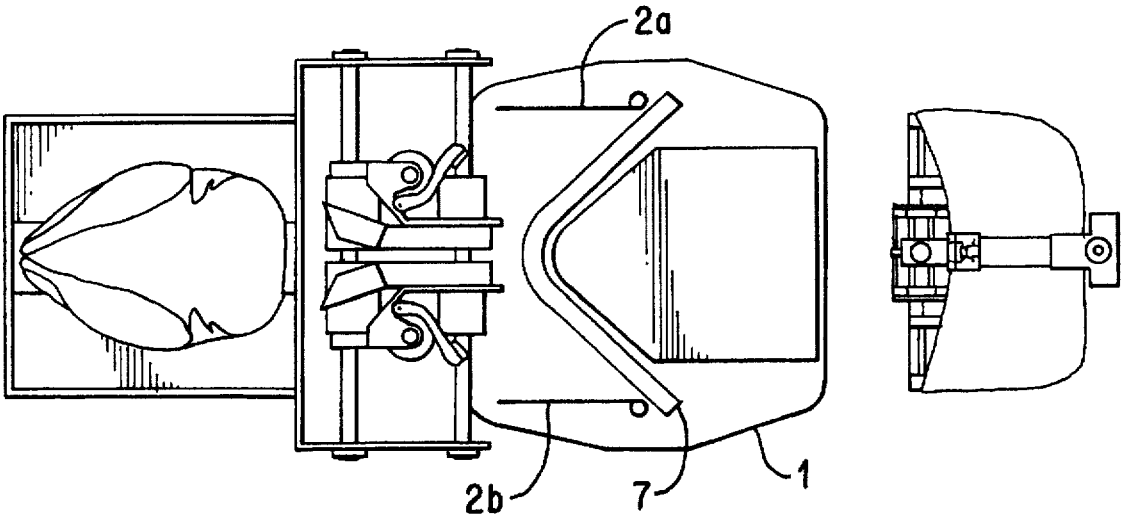
FIG. 15 shows a plan view of a product loaded into the receiving station.
Figure 16:
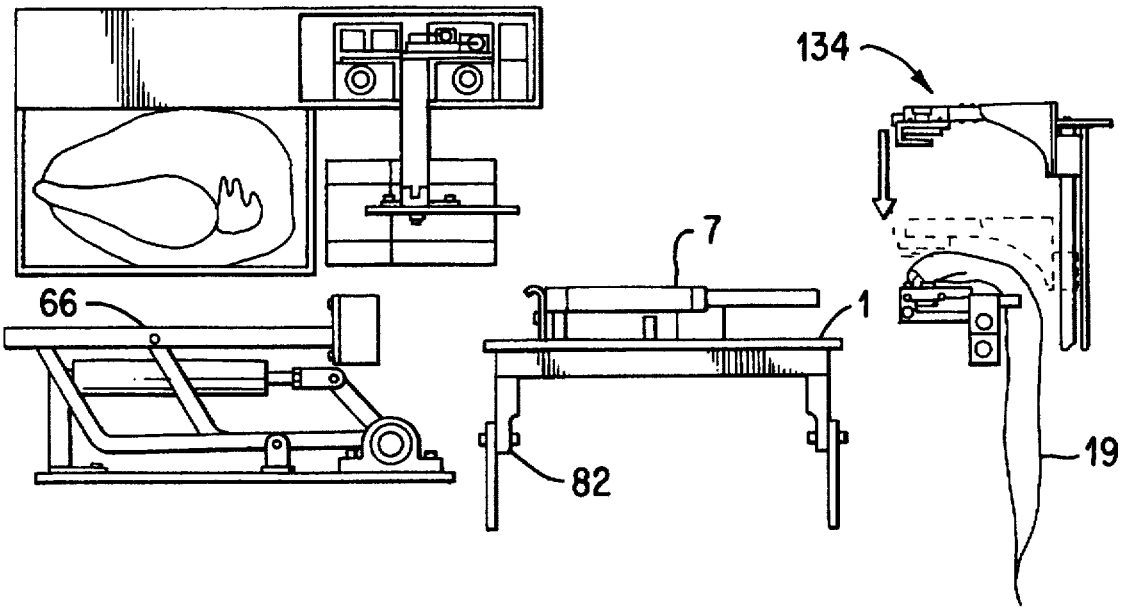
FIG. 16 shows an elevational view of the product and the receiving station of FIG. 15.
Figure 17:
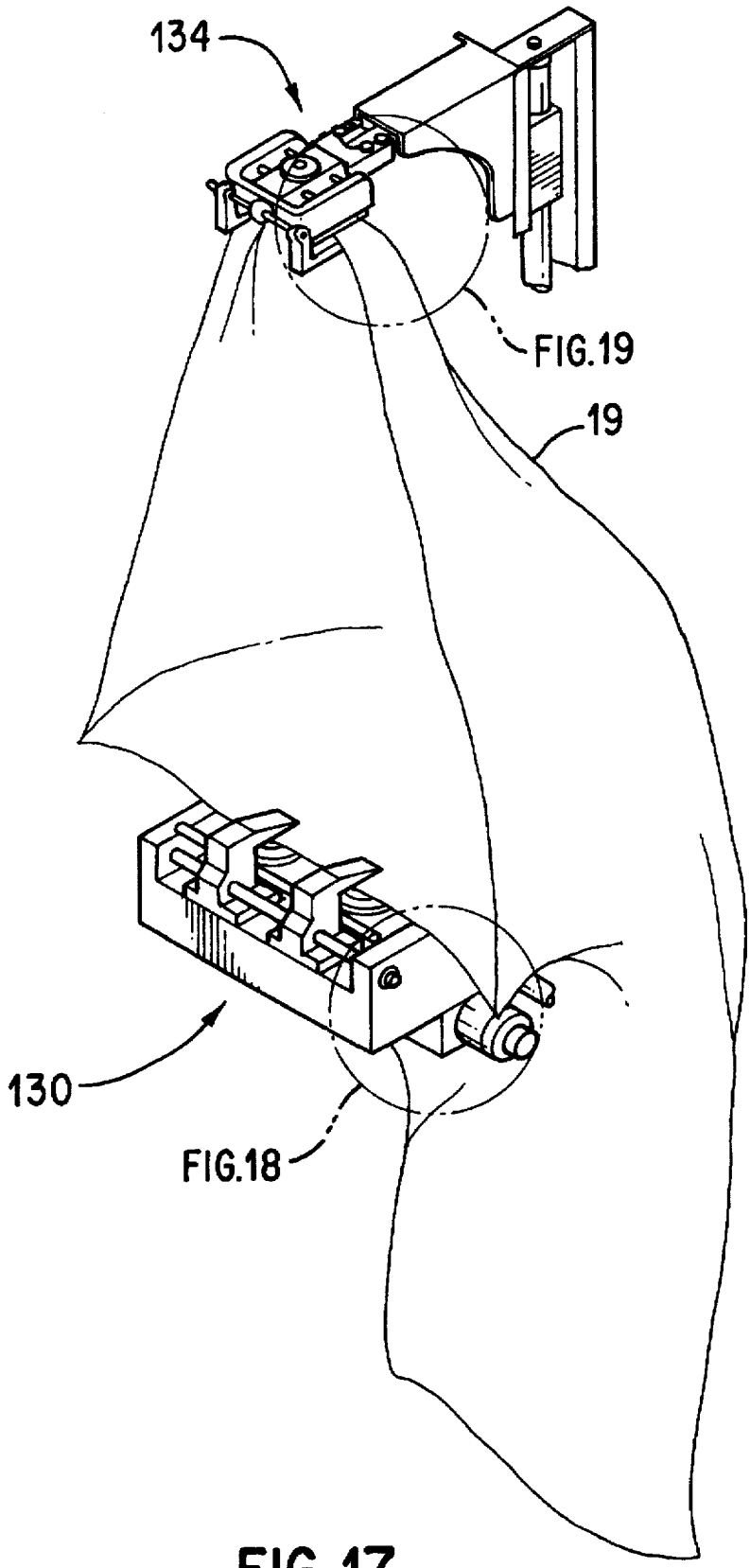
FIG. 17 shows a perspective view of a bag held open by a top and bottom clamp of the present invention.
Figure 18:
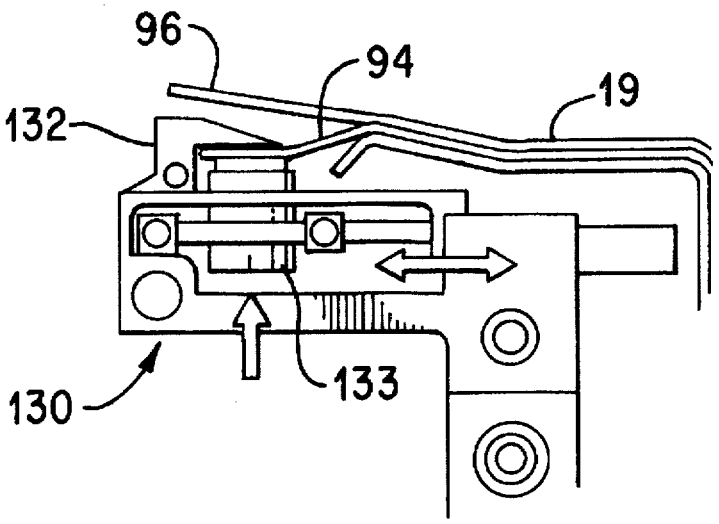
FIG. 18 shows a schematic view of the bottom clamp assembly of the invention.
Figure 19:
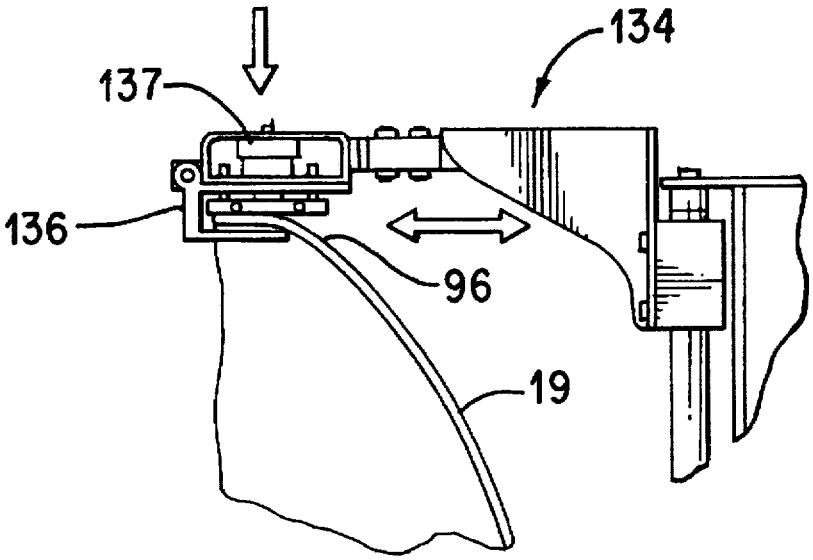
FIG. 19 shows a schematic view of the top clamp assembly of the invention.

FIGS. 15 and 16 show a bag 19 with its bottom lip secured by the bottom clamp 132, while the top clamp assembly 134 including top clamp 136 is lowered into position to grip the top lip of the bag 19. This can also be seen in FIG. 17, where the bottom clamp assembly 130 and top clamp assembly 134 have been moved vertically and horizontally into position and grasped the bottom and top lips respectively of the bag 19 to be loaded with the poultry product. As seen in FIGS. 18 and 19, the bottom clamp assembly 130 includes a bottom clamp 132 and a bottom clamping cylinder 133. The top clamp assembly 134 includes a top clamp 136 and a top clamping cylinder 137.

Figure 20:
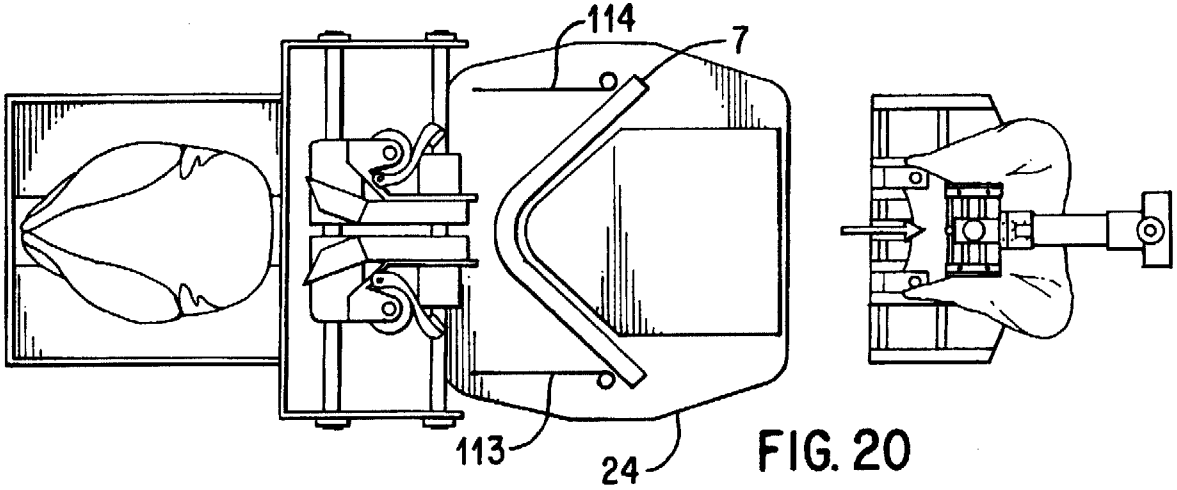
FIG. 20 shows a plan view of a bag indexed into the top clamp assembly of the present invention.
Figure 21:
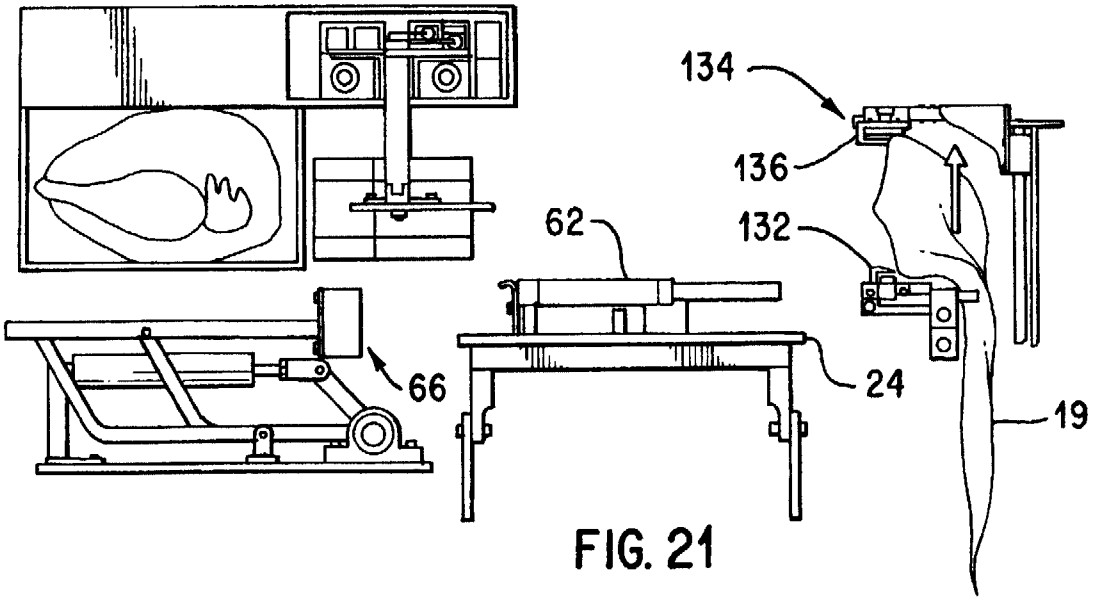
FIG. 21 shows an elevational view of FIG. 20.
Figure 22:
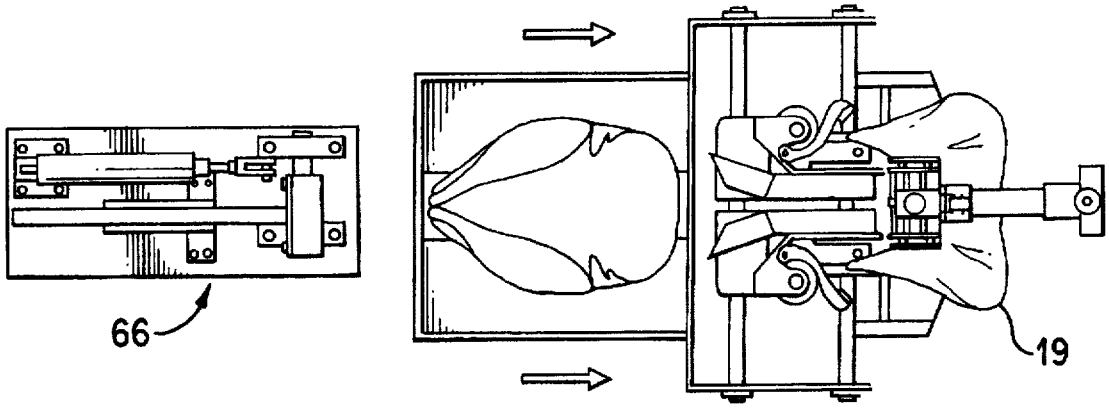
FIG. 22 shows a plan view of the product as it is moved toward the open bag.
Figure 23:
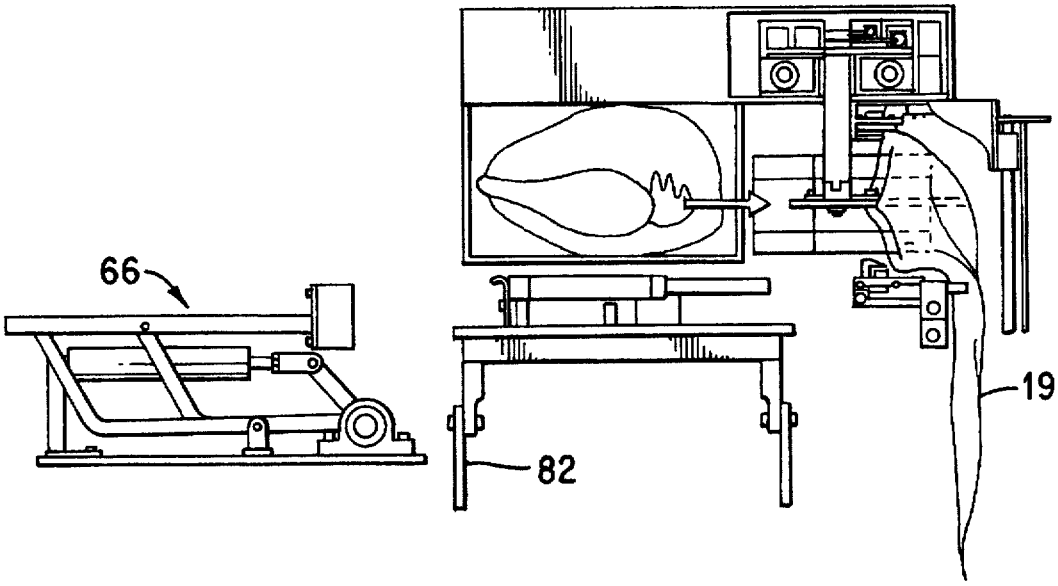
FIG. 23 shows an elevational view of FIG. 22.

FIG. 20 shows a plan view of a bag 19 with the top clamp 136 which has been lowered, inserted into the bag, clamped onto the top bag lip, and returned to the raised position. As the top clamp is raised, clamped to the top bag lip, the bag is opened because the bottom bag lip is already clamped by the bottom clamp. FIG. 21 shows an elevational view of the product and the carriage assembly, and open bag 19 of FIG. 20. With the bag thus open, the carriage assembly moves over the platen, bringing the poultry product towards the open bag. The bag openers are inserted into the opened bag. This is shown in FIGS. 22 and 23.

Figure 24:
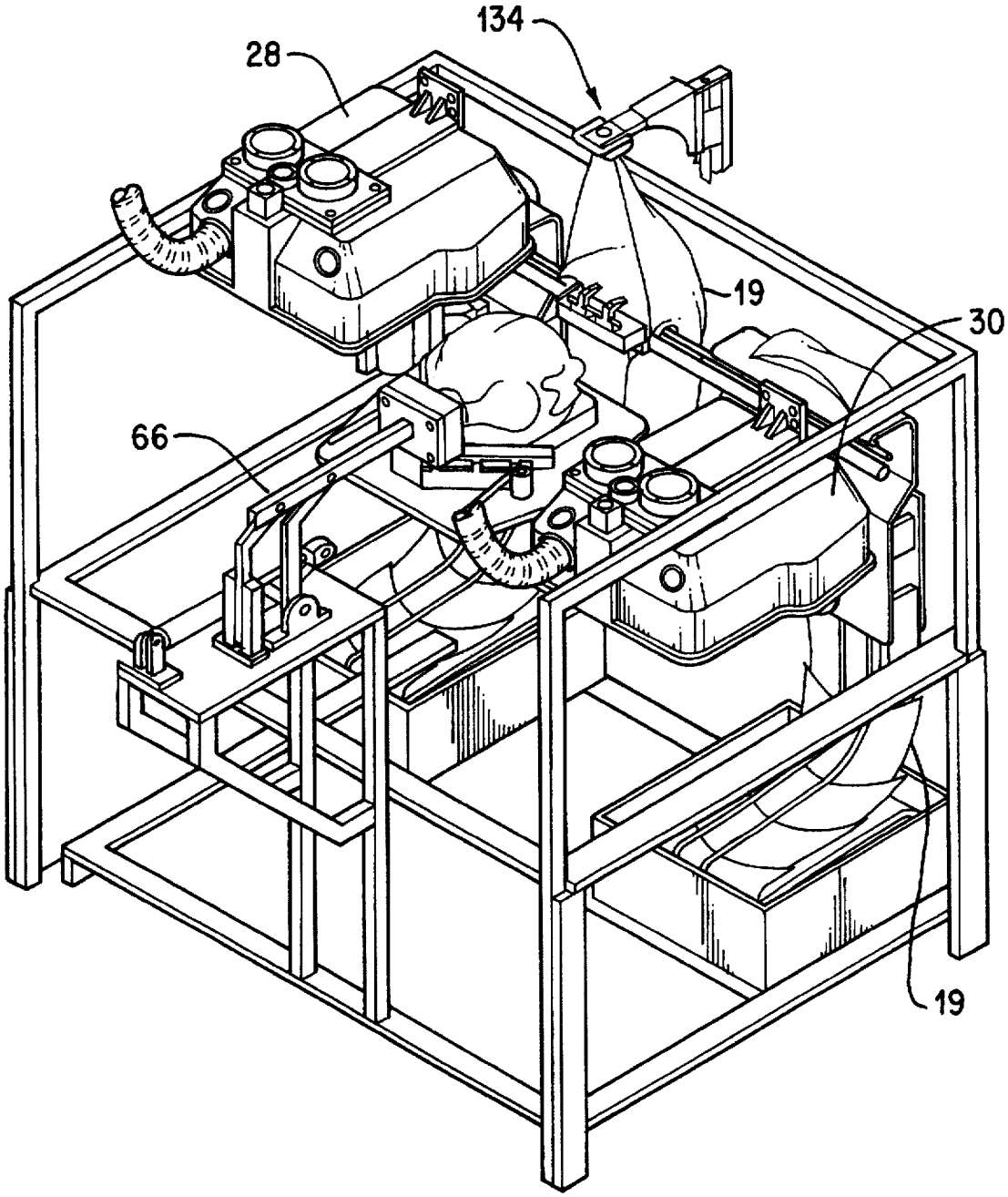
FIG. 24 shows a perspective view of features of the present system.

FIG. 24 shows a perspective view of the system just prior to the insertion of the poultry product into the bag 19 by drawing the bag towards the product while arresting the backward movement of the product by means of stop arm 66.

Figure 25:
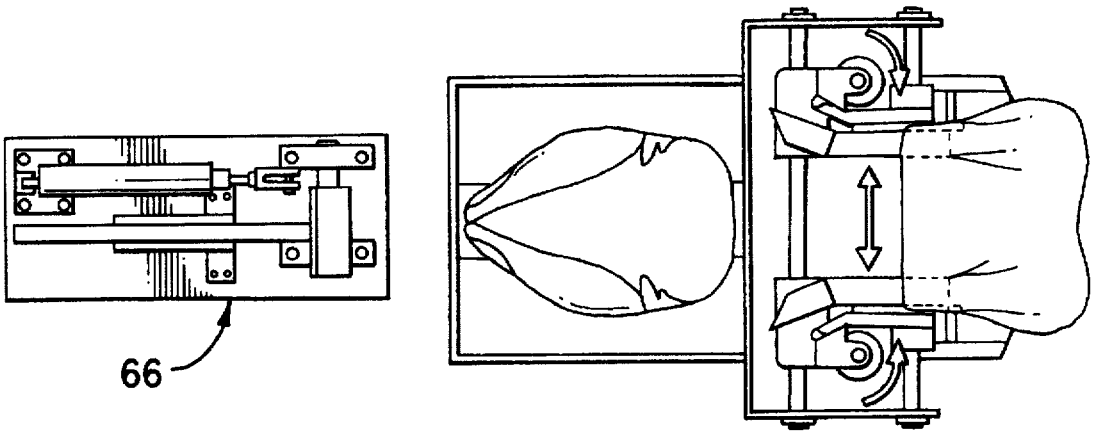
FIG. 25 shows a plan view of the top and bottom clamps released from the open bag in accord with the invention.
Figure 26:
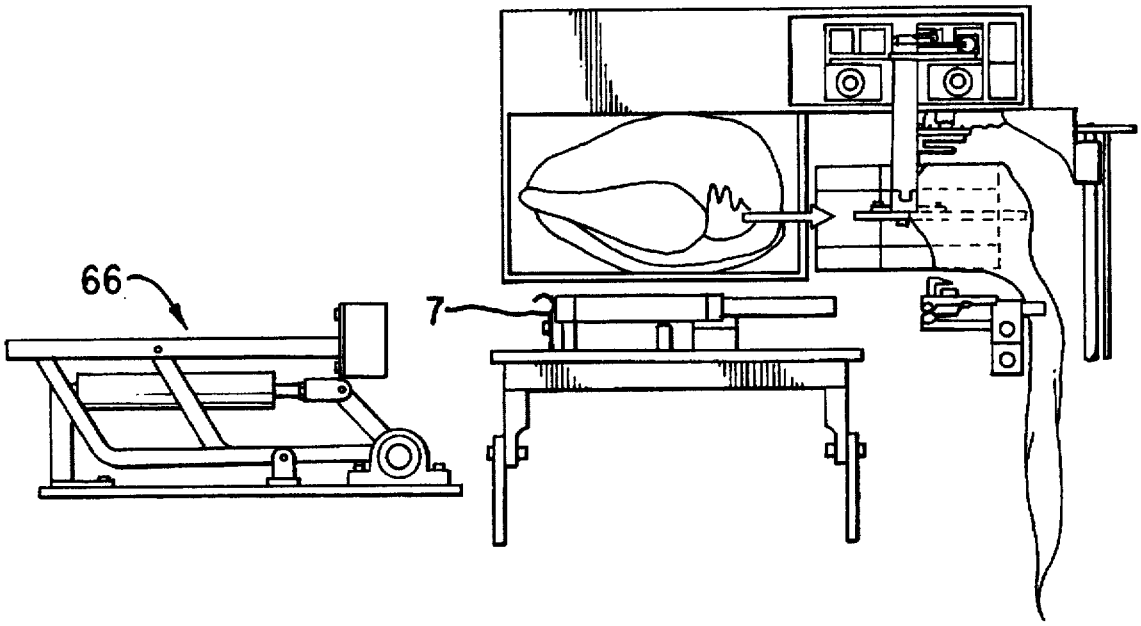
FIG. 26 shows an elevational view of FIG. 25.

FIGS. 25 and 26 show the top and bottom clamps released and drawn away from the opened bag. Bag openers are spread to accommodate the poultry product. Lateral bag clamps 113 and 114 are activated to clamp the lateral sides of the bag.

Figure 27:
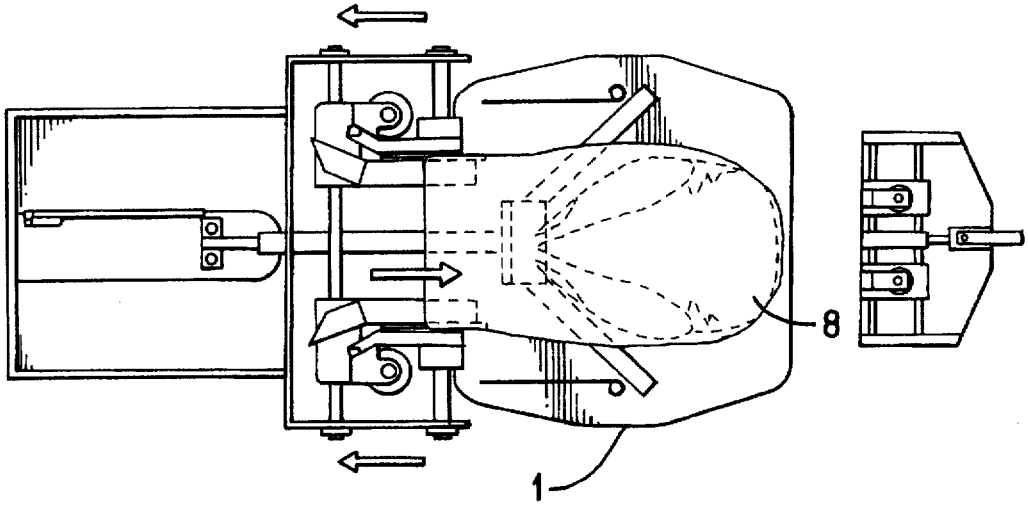
FIG. 27 shows a plan view of a stop arm moved to a raised position behind the product, and the loading of the product in the bag.
Figure 28:
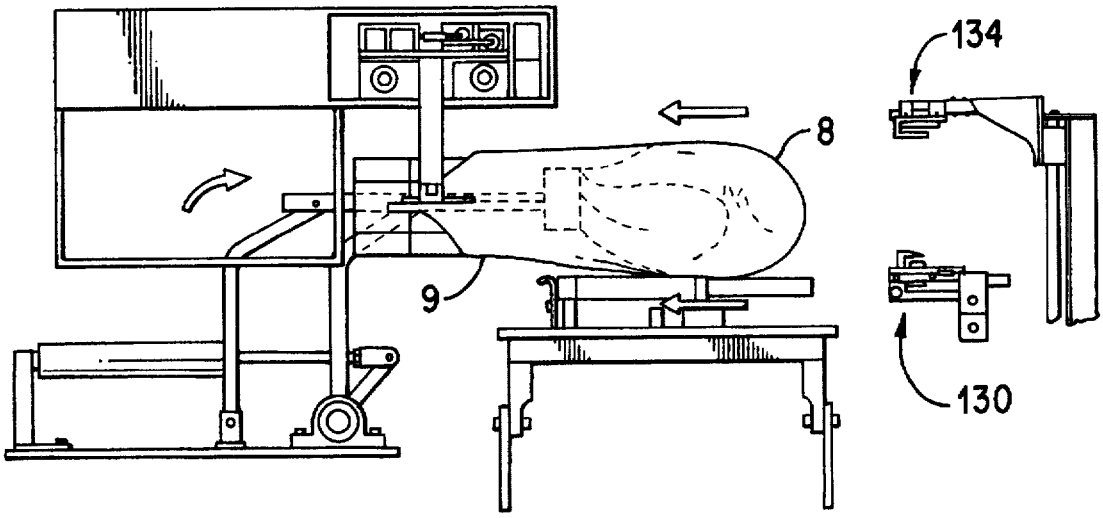
FIG. 28 shows an elevational view of the stop arm and other components of FIG. 27.

In FIGS. 27 and 28, a stop arm moves to the raised position behind the poultry product. This can also be seen in FIG. 24. The carriage assembly returns to the "home" position", i.e. to the original loading position for receiving the next product. The opened bag 19 is then pulled laterally over the poultry product, with the bag lips extended as shown.

Figure 29:
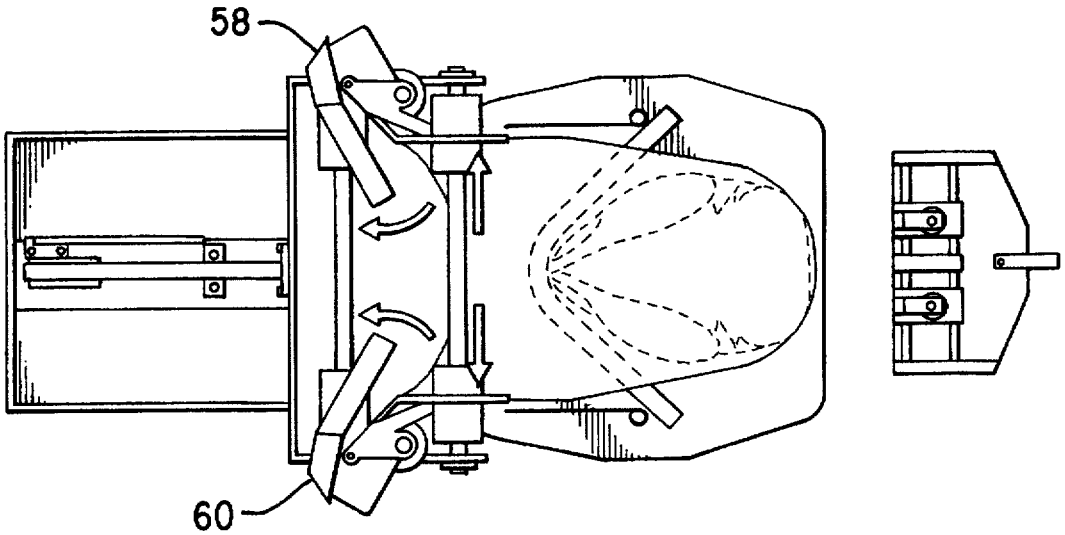
FIG. 29 shows a plan view of the system with the stop arm removed, bag openers rotated out of the bag, and spreader arms pulling the bag neck into a flat position.
Figure 30:
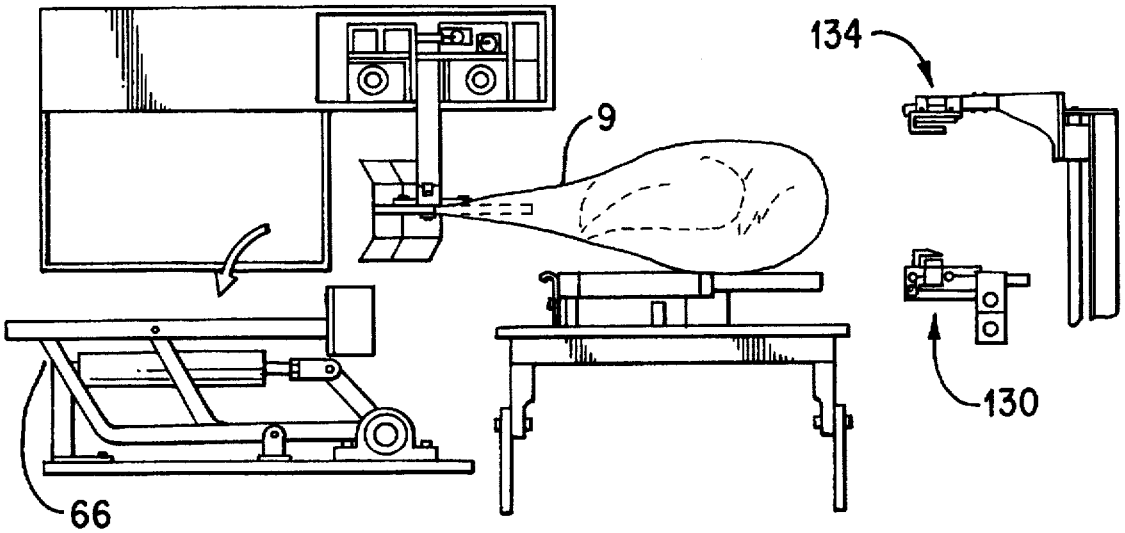
FIG. 30 shows an elevational view of the system of FIG. 29.

FIGS. 29 and 30 show the stop arm returned to its original lowered position, the bag openers withdrawn from the bag (by rotation in a preferred embodiment), and spreader rods spread apart to pull the bag neck flat.

Figure 31:
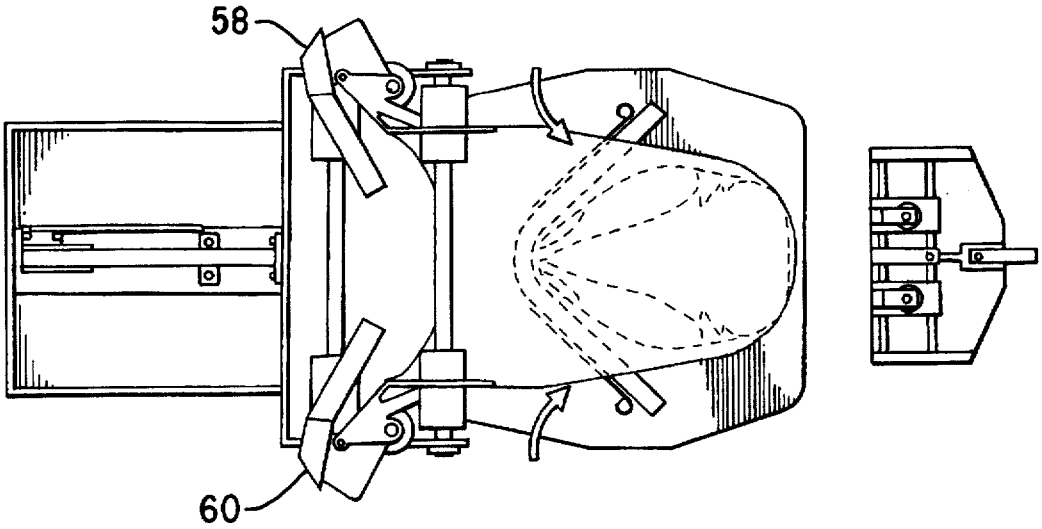
FIG. 31 shows a plan view wherein the product and platen are lowered.
Figure 32:
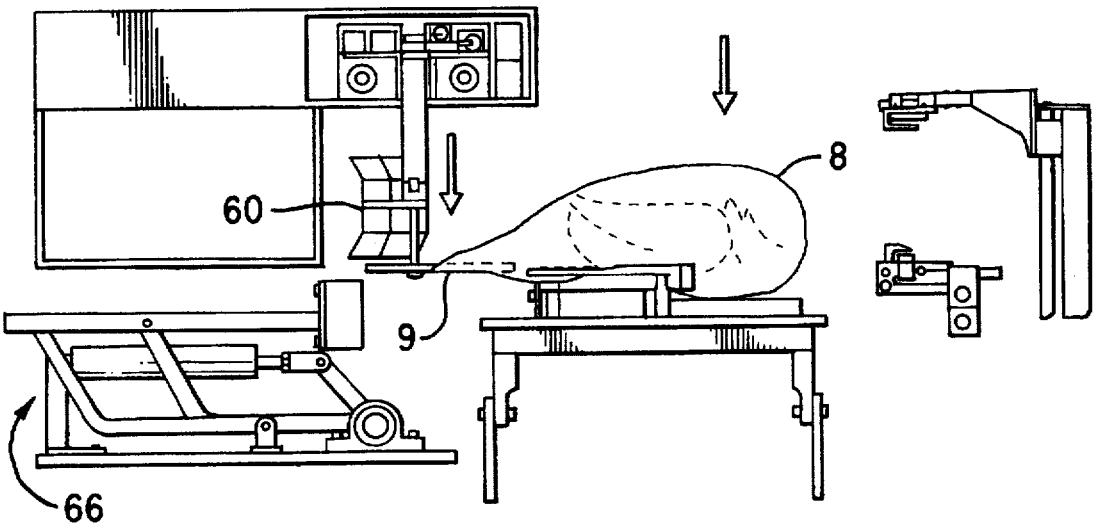
FIG. 32 is an elevational view of FIG. 31.

FIGS. 31 and 32 show the platen elevator lowering the bagged product. The spreader rods are also lowered, placing the bag neck over the seal bar. Platen bag clamps close by movement through a horizontal plane, thus securing the bag in place. The spreader rods are withdrawn from the bag (by rotation in a preferred embodiment) and returned to their original raised position.

Figure 33:
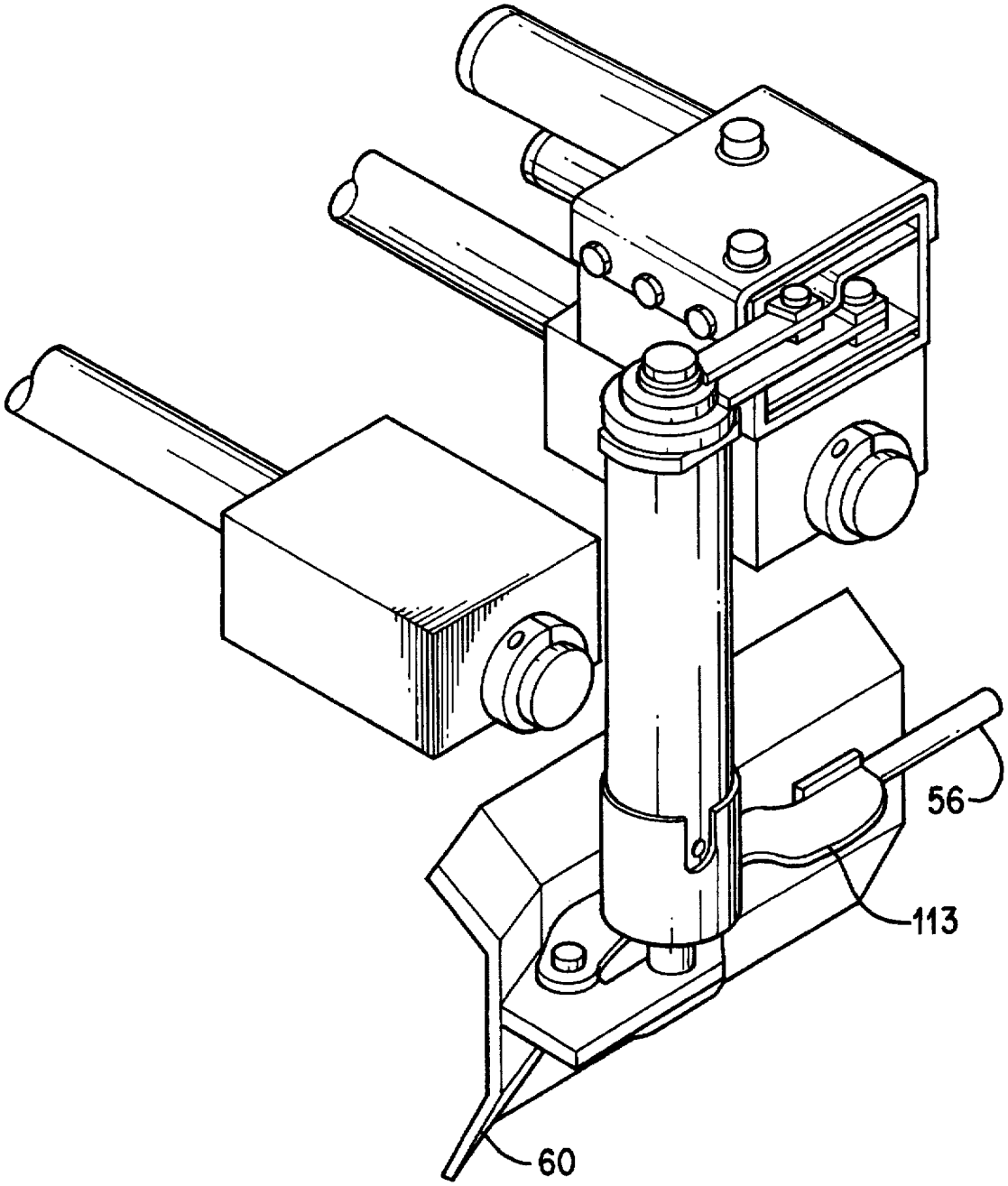
FIG. 33 is a perspective view of certain components of the system.

FIG. 33 is a perspective, enlarged view of a portion of the system, showing actuating air cylinders, bag opener, lateral bag clap, and spreader rod.

Figure 34:
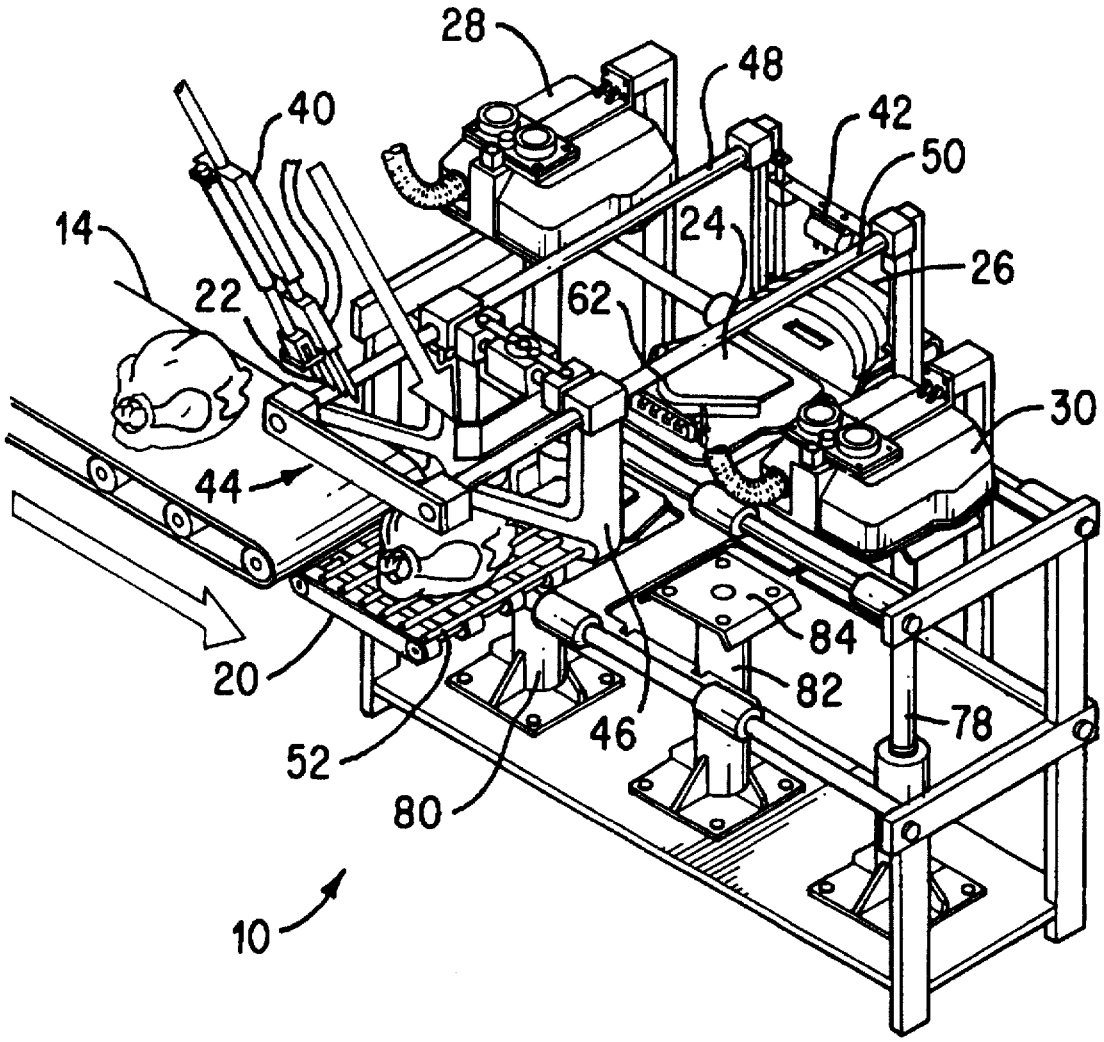
FIG. 34 is an alternative embodiment of the system of the present invention.
Figure 35:
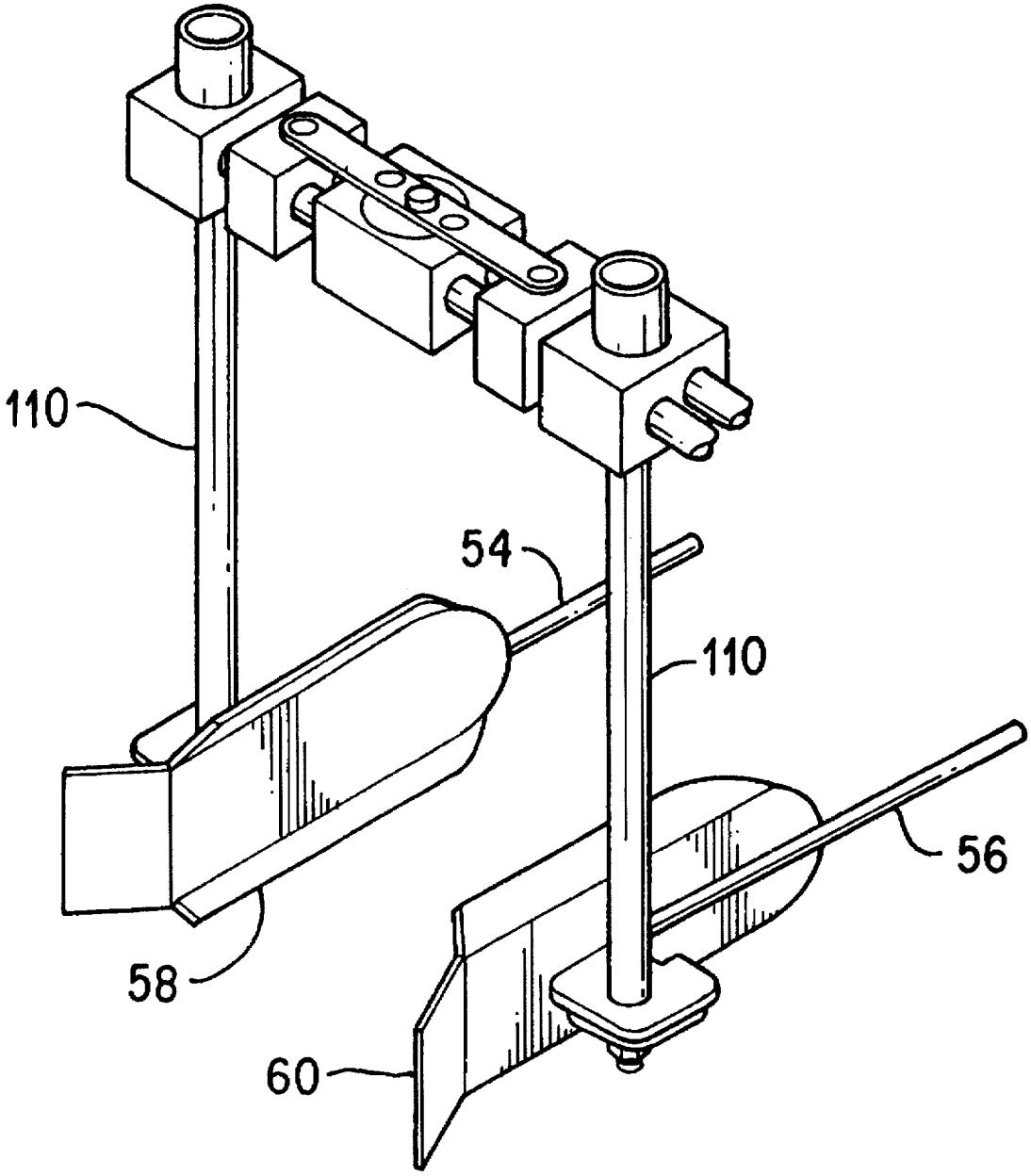
FIG. 35 shows spreader bar and loading horn components of an alternative embodiment of the present system.

Referring now to the alternative embodiment of FIG. 34, the system 10 has a receiving station 20 which is in the form of a transfer conveyor for the product to be bagged. The needles 22 and a mechanism 40 for extending them into and retracting them from the breast of the product are positioned over the receiving station. The needles may be connected to a source of measured basting fluid through any suitable conduit arrangement known in the art. A commercial basting system suitable for use in the automated system of the present invention is manufactured and sold by Artran, Inc. of Springdale, Ark.

The system 10 has at least one bag indexer 26, preferably a tape indexing system cooperating with a supply of bags 19 positioned below said indexing system. The bag indexer 26 may comprise any suitable tape indexing or other indexing system known in the art. The indexing system 26 takes a bag 19 from the supply and positions it adjacent the bagging station 23 with its mouth or open end facing the product to be bagged. A suitable bag indexing system is employed on Cryovac Model 8189 packaging system. The system 10 includes a means 42 for opening the mouth of the bag 19 and holding it open.

The system 10 also has a transfer unit 44 for transferring the product from the receiving station 20 to the bagging station 23. The transfer unit preferably is in the form of a carriage assembly which includes a carriage 46 which is movable along carriage rails 48 and 50. The carriage 46 has a transfer support 52 mounted thereto. The transfer support 52 slides under the product to be bagged and carries the product from the receiving station 20 to the bagging station 23. In the embodiment illustrated in FIG. 3 the transfer support comprises a plurality of rods, however, a plate could be substituted for the rods.

Figure 36:
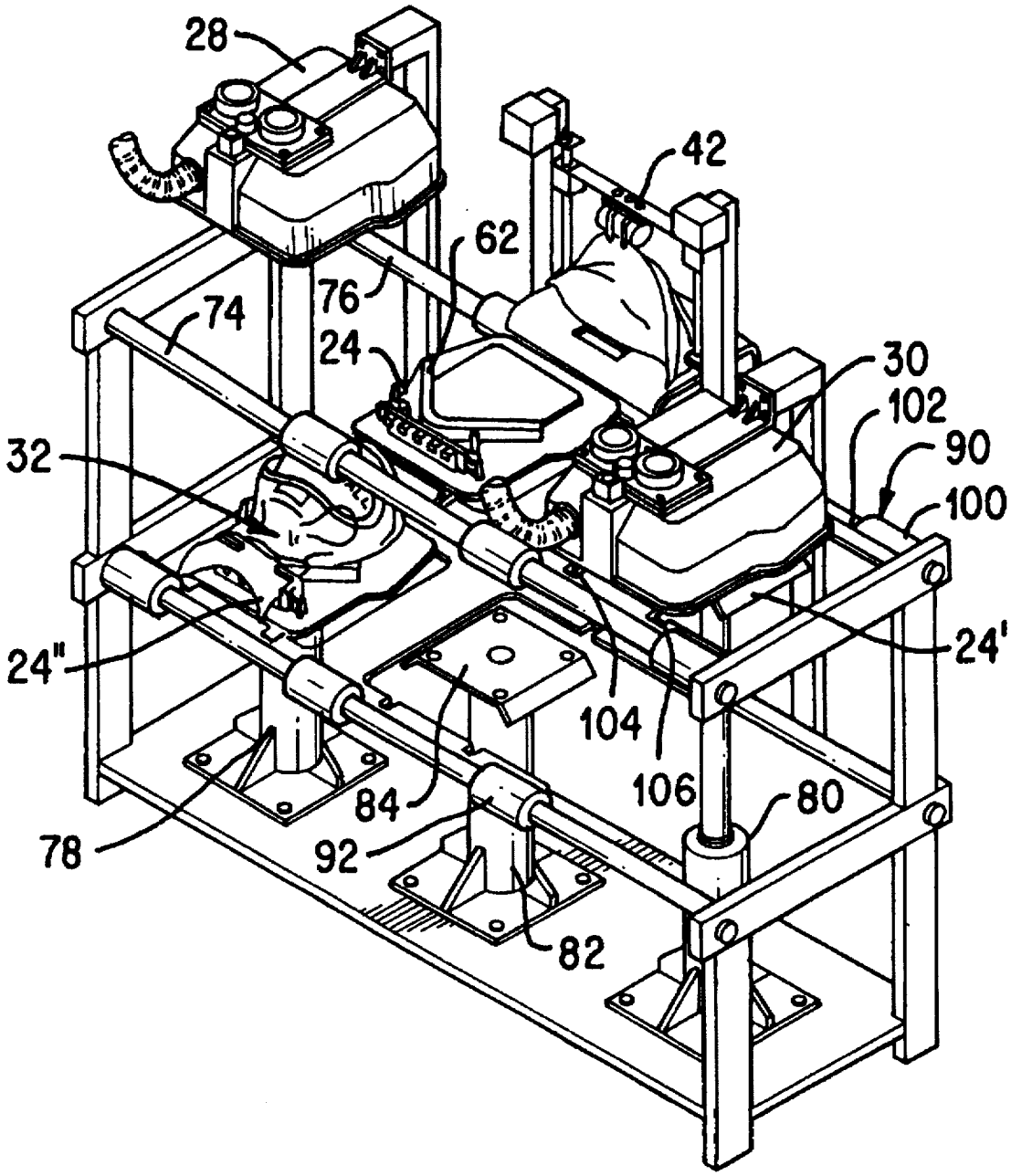
FIG. 36 is a perspective view of an alternate embodiment of the platen shuttle system.
Figure 37:
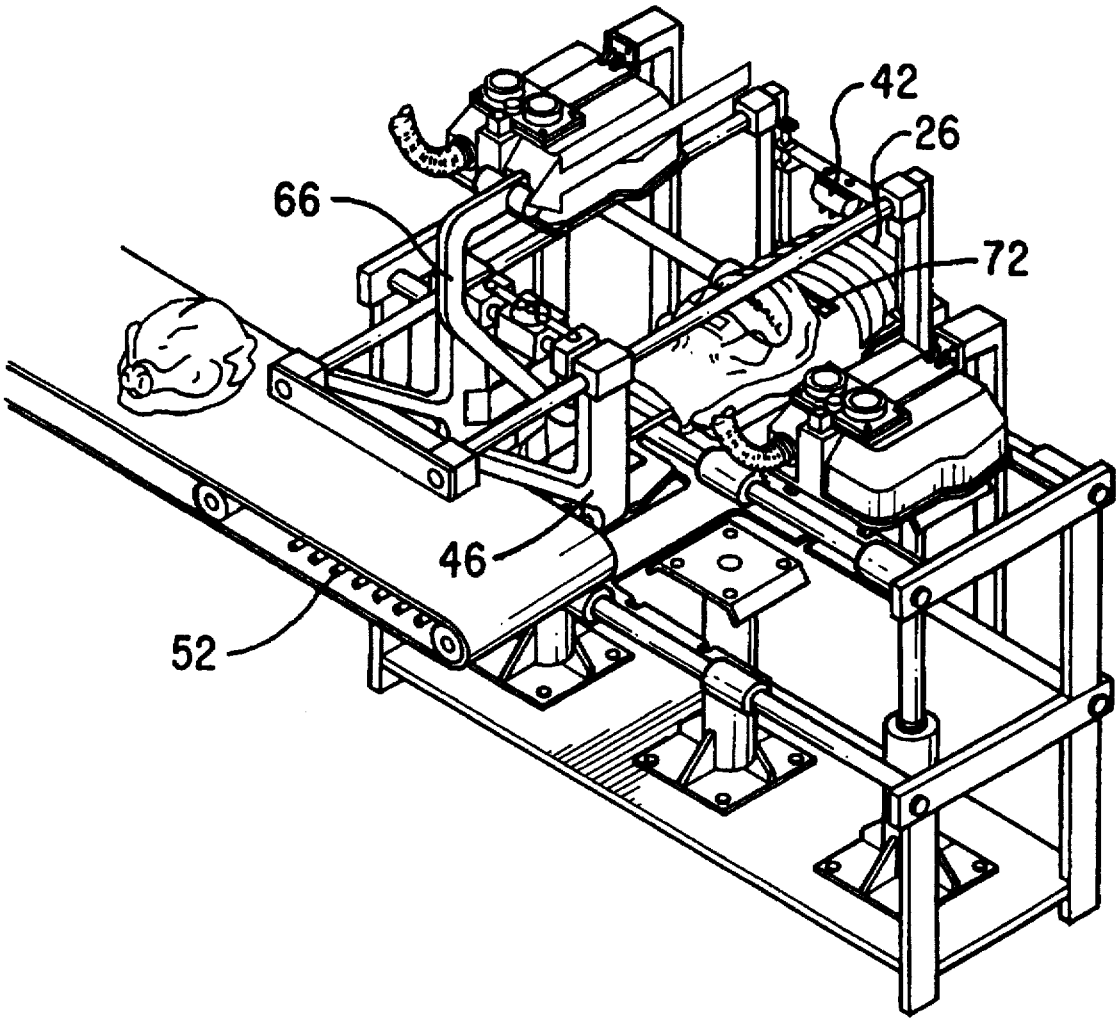
FIG. 37 is a perspective view of the system of FIG. 36 as a bag is pulled over a product.

The system 10 also includes a plurality of platens 24, 24' and 24" for moving the product through various stations. FIG. 36 illustrates the platen 24 in a position for receiving a bagged product. As can be seen in this Figure, the platen 24 has a seal seat 62 for cooperating with a mechanism for sealing the bag 19 placed over the product in a manner known in the prior art.

Figure 38A:
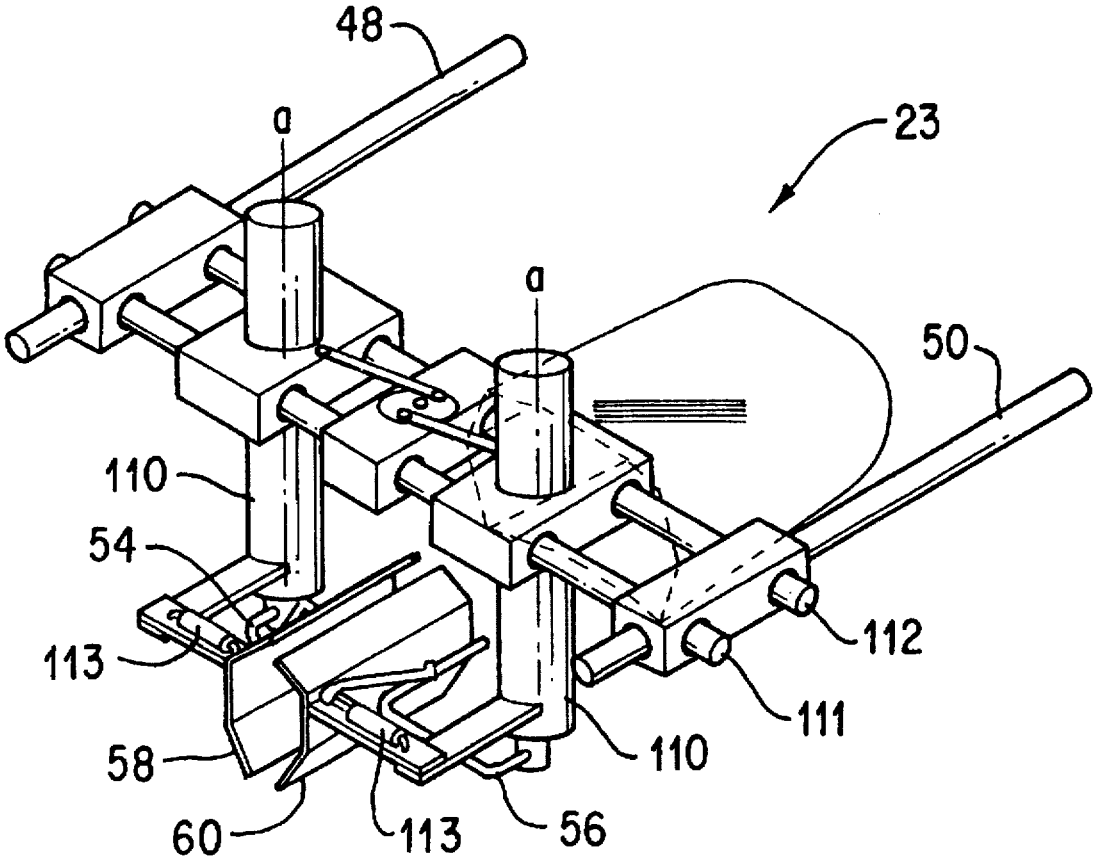
FIGS. 38*a*–38*h* show product loading in the system of FIG. 34.
Figure 38B:
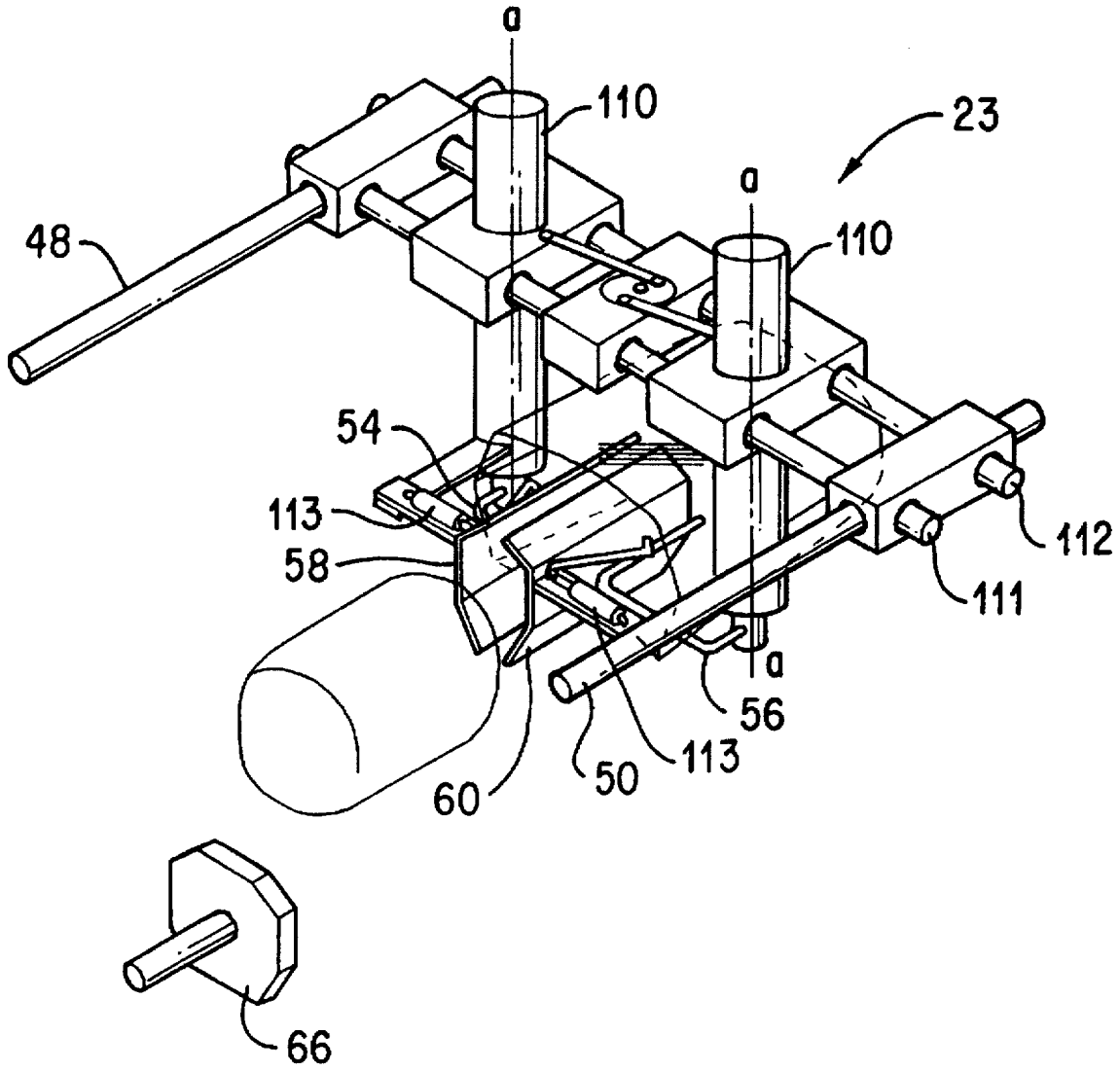
Figure 38C:
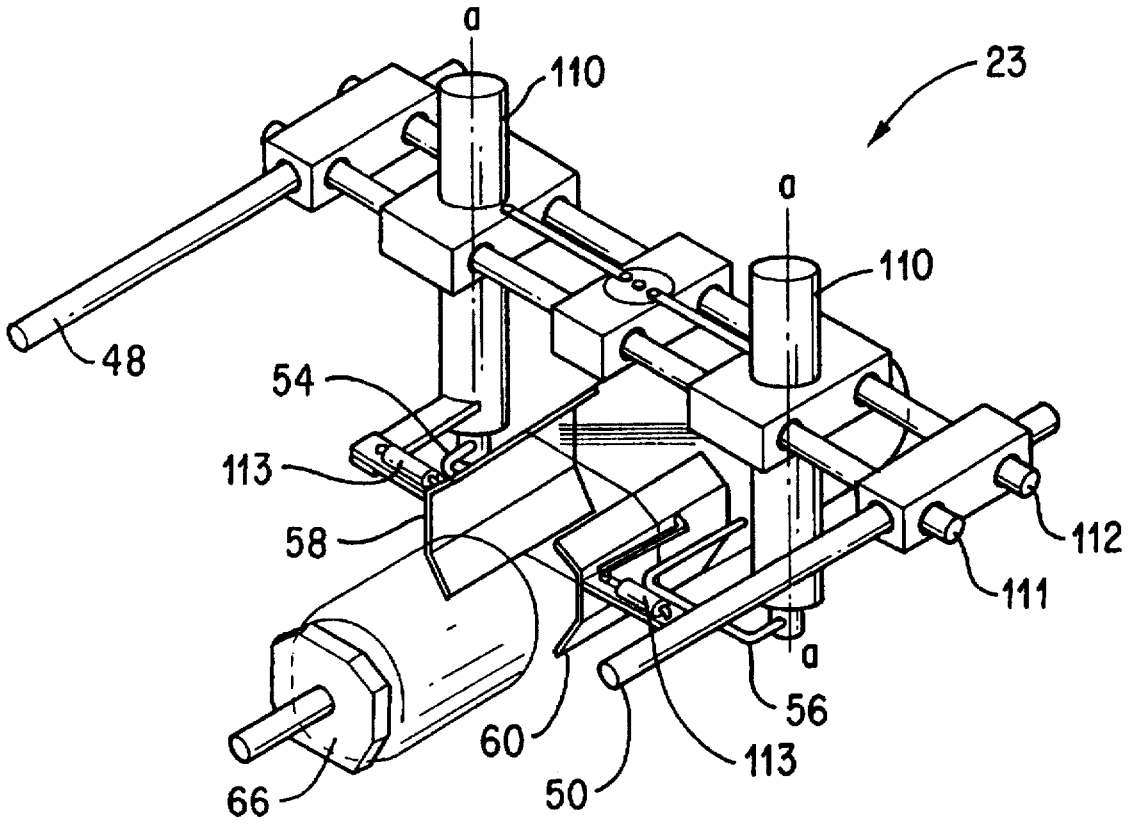
Figure 38D:
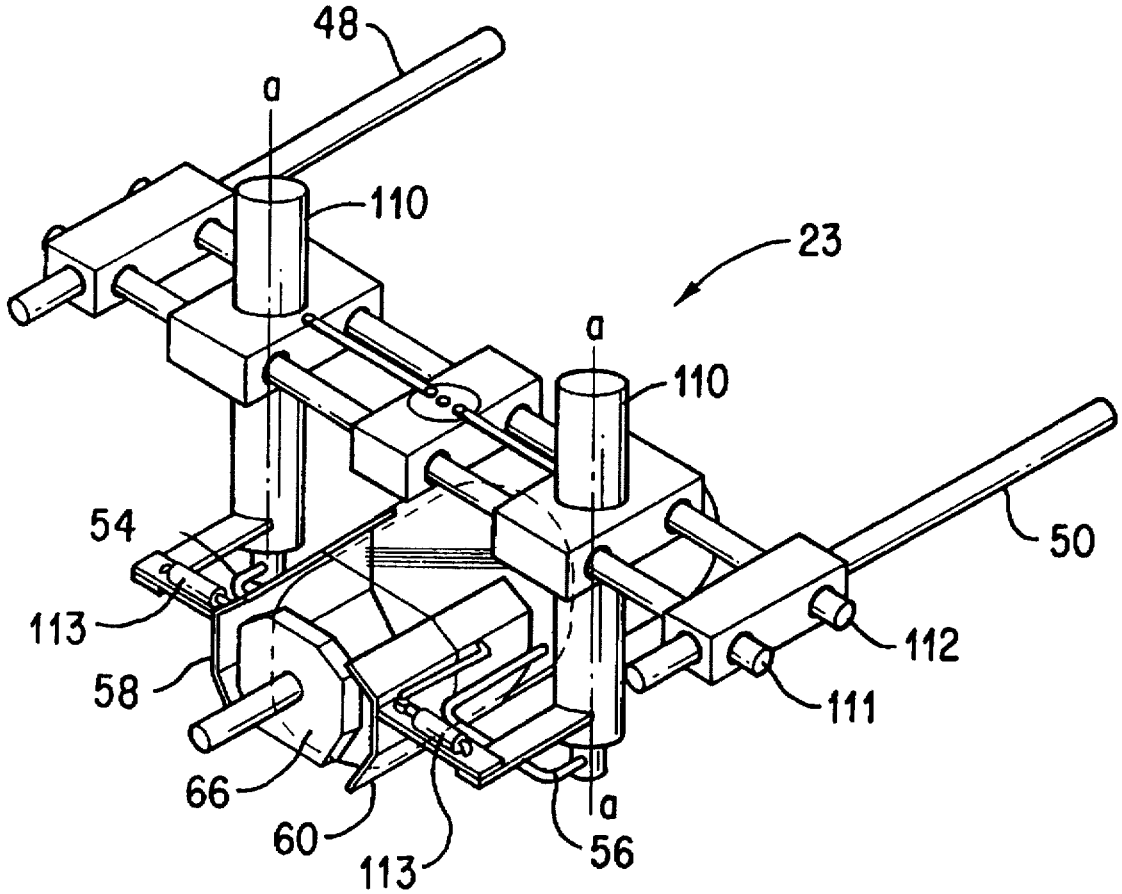
Figure 38E:
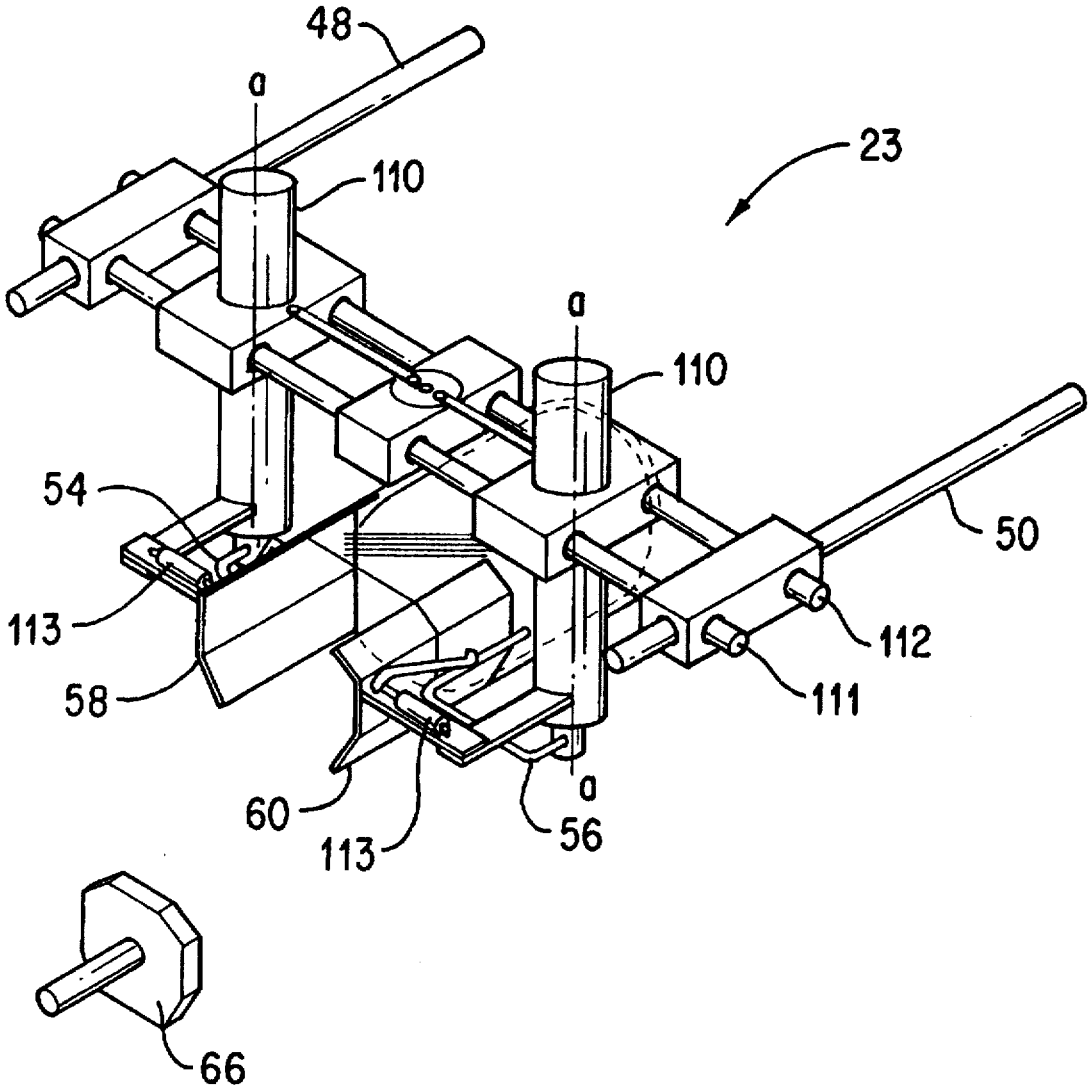
Figure 38F:
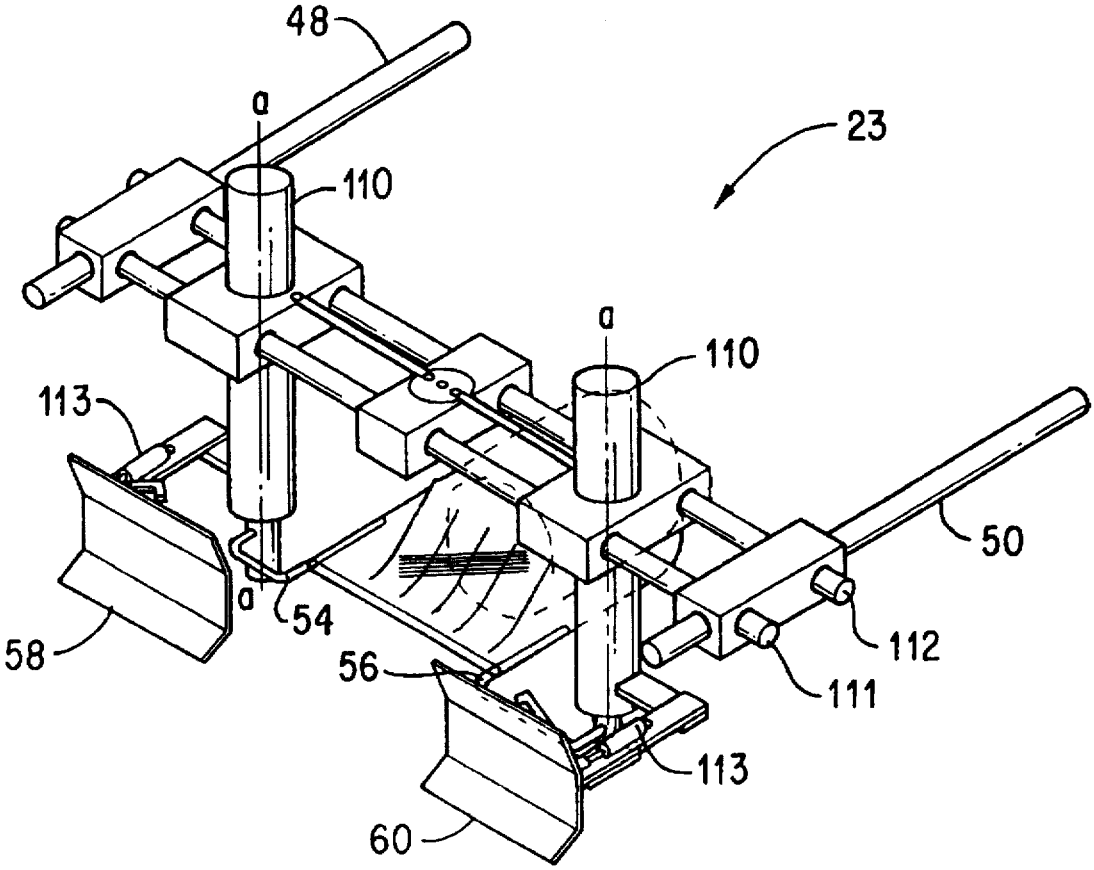
Figure 38G:
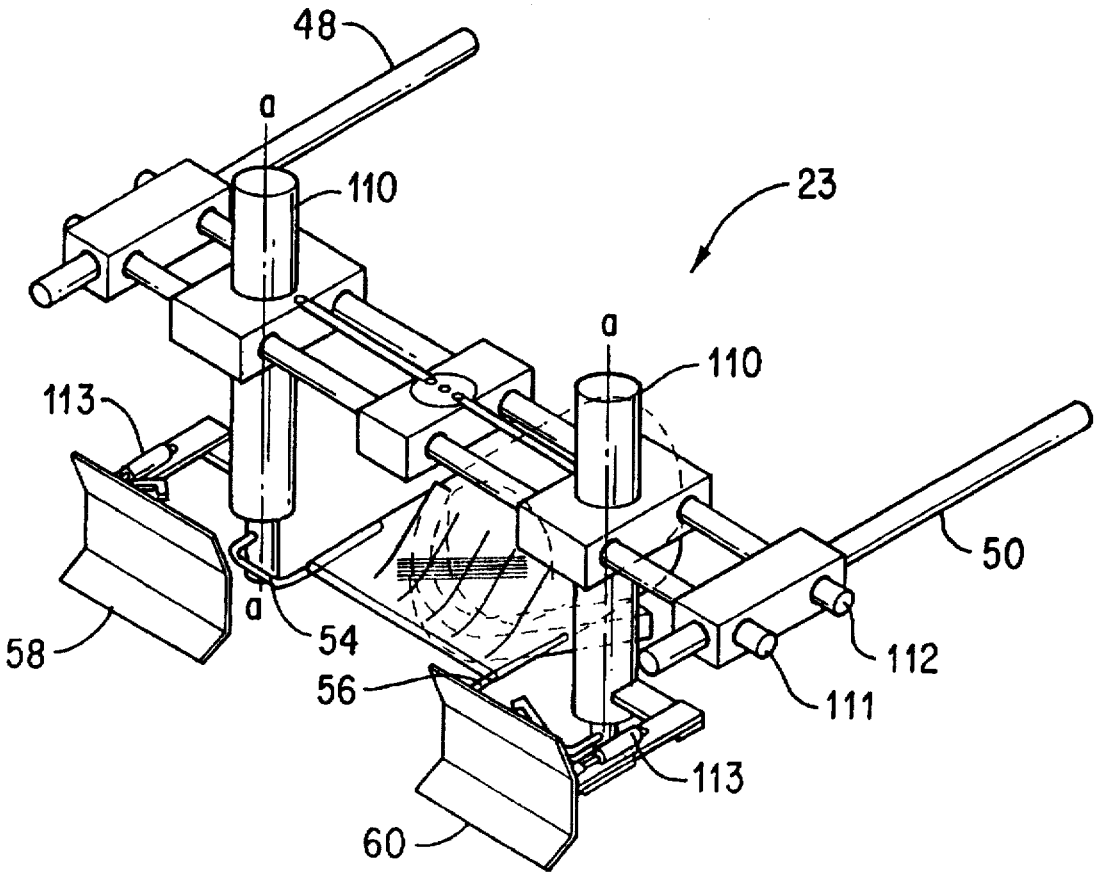
Figure 38H:
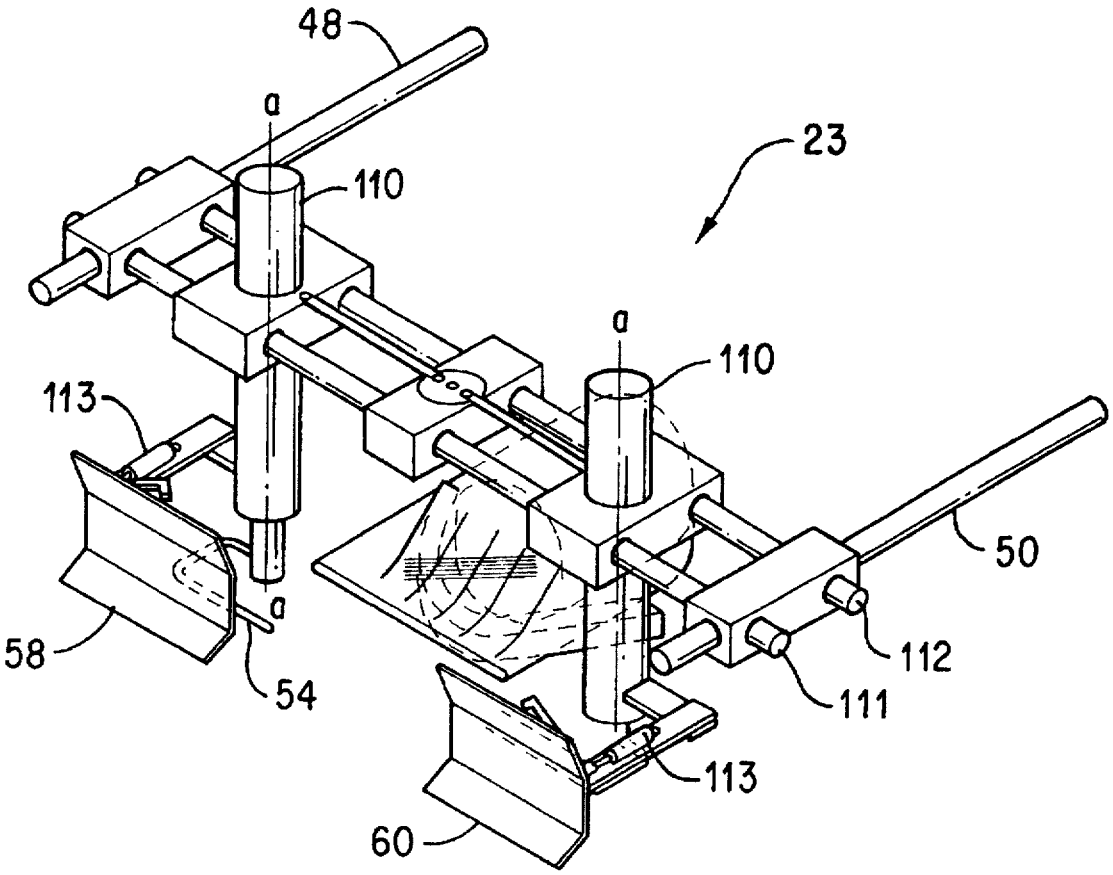
Figure 39A:
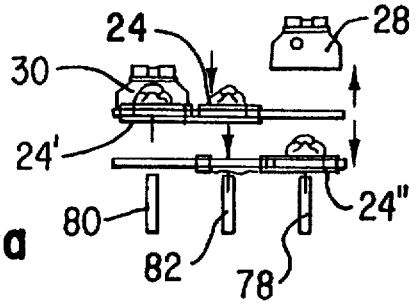
FIGS. 39*a*–39*j* show the "figure eight" path of travel of the platens in accord with the invention.
Figure 39F:
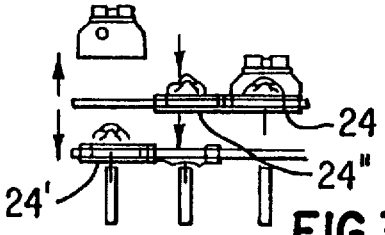
Figure 39B:
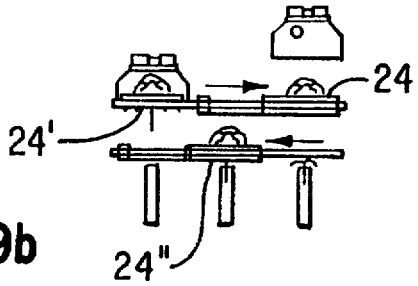
Figure 39G:
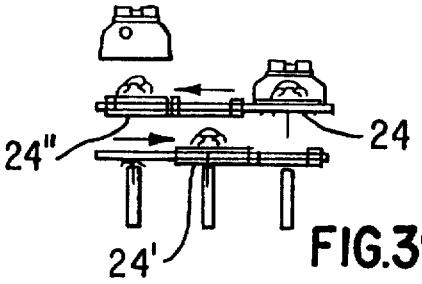
Figure 39C:
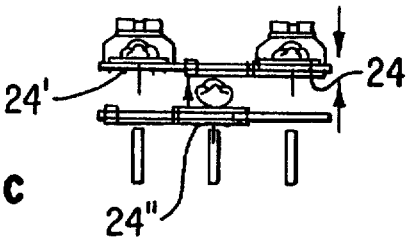
Figure 39H:
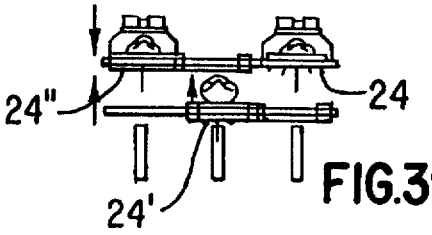
Figure 39D:
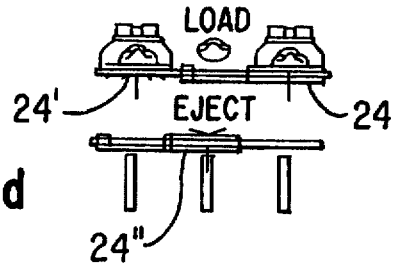
Figure 39I:
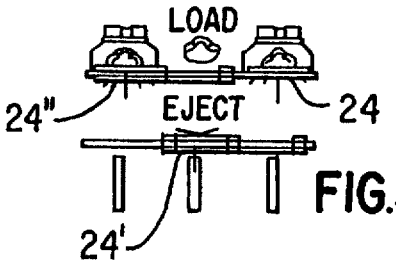
Figure 39E:
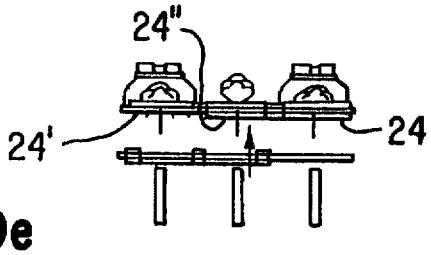
Figure 39J:
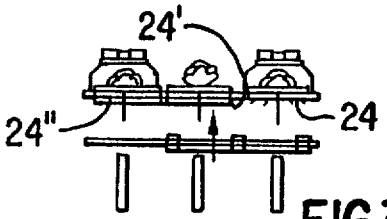

The bagging of the product is illustrated in FIGS. 38*a*–38*h*. The carriage assembly shown in FIG. 38*a* with the product positioned on transfer support 52 (shown in FIG. 34) is moved along carriage rails 48 and 50 towards the bagging station 23. As the carriage 46 moves further along the carriage rails 48 and 50, the loading horns 58 and 60 and the spreader bars 54 and 56 move into the open mouth of the bag 19 as shown in FIG. 38*b*. The loading horns and spreader bars which are attached to the multi-motion actuator 110 move away from each other by moving the multi-motion actuator 110 along rails 111 and 112 securing the bag 19 to the horns and spreader bars as shown in FIG. 38*c*. Ability to hold the bag 19 on the loading horn and spreader bars is increased by closing bag clamps 113, 114. After the product and carriage assembly has reached the bagging station 23, a stop arm 66 rotates towards and contacts the product to hold it in place. The carriage 46 is then moved back toward the receiving station 20 as shown in FIG. 38*d*. The loading horns mounted to the multi-motion actuator 110 move with the carriage 46. As the carriage 46 moves, the product by virtue of the stop 66 is removed from the transfer support 52 (shown in FIG. 34) and passes through the space defined by the opening horns 58 and 60. After the product is fully positioned within the bag 19, the stop is retracted through the space defined by the opening horns 58, 60 as shown in FIG. 38*e*. The bag clamps are opened. After the stop 66 has been removed and the bag clamps opened the opener horns are removed by rotating around the vertical axis a—a by multi-motion actuator 110 as shown in FIG. 38*f*. As the openers are removed, the open mouth of the bag 19 is maintained taut and effectively spread to a near flat orientation by moving the multi-motion actuators 110 away from each other along rails 111, 112. With the spreader bars holding the bag 19 in a spread position the spreaders move in a downward direction placing the top lip of the bag 19 in a position below the top of the seal seat 62 as shown in FIG. 38*g*. Transfer of the bag 19 to the platen is made by allowing the platen clamps to rotate in a horizontal plane and clamping the bag 19 against the vertical surface of the seal seat 62. With the bag 19 secured, the spreader bars are removed by rotating around axis a—a of the multi-motion actuator as shown in FIG. 38*h*. To ready for the next cycle the spreader bars are raised to its first elevation near the center of the loading horns and both spreader bars and loading horns are rotated to its first position.

As previously mentioned, the system 10 includes two vacuumizing stations 28 and 30 on the same elevation as the bagging station 23. The vacuumizing stations may comprise any suitable means known in the art for vacuumizing, sealing and trimming the bag 19 around the product such as Cryovac Model VC14. The platen 24 may be moved to one of the stations 28 and 30 using the shuttle system 90 by sliding it along the rails 74 and 76. The shuttle system 90 comprises members 100 slidable along rails 74 and 76. Flange members 102 are attached to the members 100. Each flange member 102 has a plurality of notches 104 for engaging pins 106 on the platen 24. Shuttle system 90 is driven by any suitable arrangement known in the art, preferably a hydraulic or pneumatic piston cylinder arrangement. When the platen 24 and the bagged product have reached one of the stations 28 and 30, the vacuumizing chamber and other equipment for performing the vacuumizing, sealing and trimming are lowered onto the platen and over the bagged product. After vacuumizing, sealing and trimming, the vacuumizing chamber is lifted and the platen is moved into contact with one of elevators 78 and 80. The elevators 78 and 80, as well as the elevator 82, are each formed by a hydraulically or pneumatically operated piston cylinder unit having a platform 84 on which the platen 24 rides.

The elevator 78 or 80 is used to move the platen 24 and the sealed package clamped thereto from the first elevational level A to the second elevational level B. On the second elevational level, there are two hold stations 32 and 34.

The platen 24 and the package clamped thereto are moved to a releasing or discharging station 36 where the trim from the sealed bag 19 is mechanically removed and the clamps holding the package to the platen 24 are released and the package is ejected onto the discharge conveyor 38. After the package has been released, the platen 24 is contacted by the elevator 82 and raised to a position for receiving the next bagged product.

Referring now to FIG. 39, it can be seen that the system 10 preferably has three platens 24 which move in a Figure eight pattern as they transport bagged products through the various stations of the system. By tracing platens 24' and 24" through FIGS. 39(*a*) to 39(*j*), one can see how the platens move through this Figure eight pattern. A platen is loaded, moved in a first direction to a first vacuum chamber, lowered to a first holding station and then moved to the discharge station. Then after, the product has been released, the platen is returned to the bagging station and loaded with another bagged product. The platen and the bagged product are moved in a second direction opposite to the first direction to a second vacuumizing station. After vacuumizing and sealing, the platen and the sealed package are moved to a second holding station and then to the discharge station.

As shown in FIG. 36, the system 10 includes two platen shuttle systems 90 and 92, one at the first elevational level A and the second at the second elevational level B. The platens 24, 24' and 24" may be locked to a shuttle by locking devices in the form of a simple tongue and groove arrangement. The shuttles 90 and 92 each have the ability to lock and transfer two platens simultaneously. After locking the platen and the shuttle, the assembly may move as a rigid component.

Figure 40:
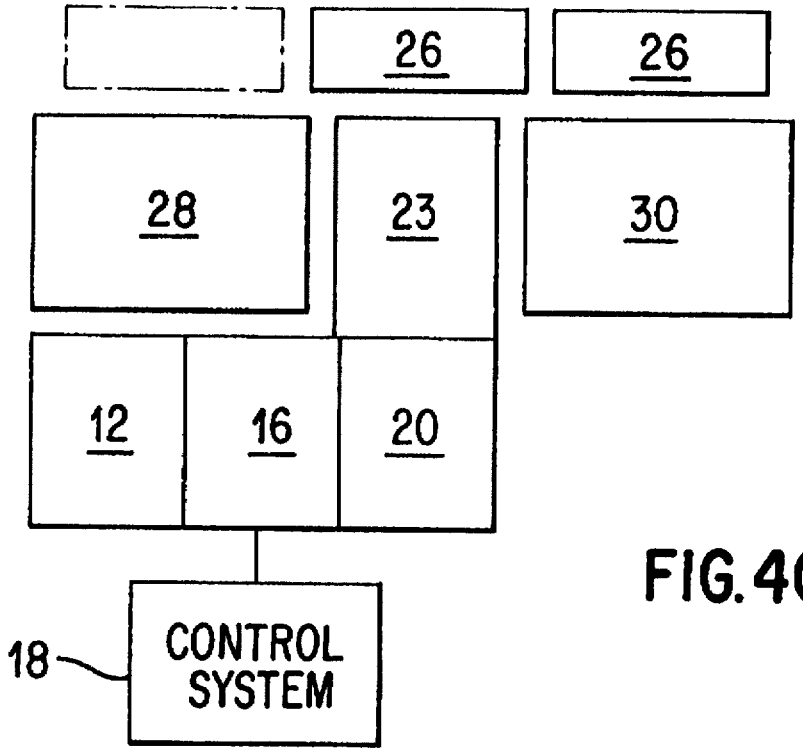
FIG. 40 is a schematic plan view of the automated system of the present invention.
Figure 41:
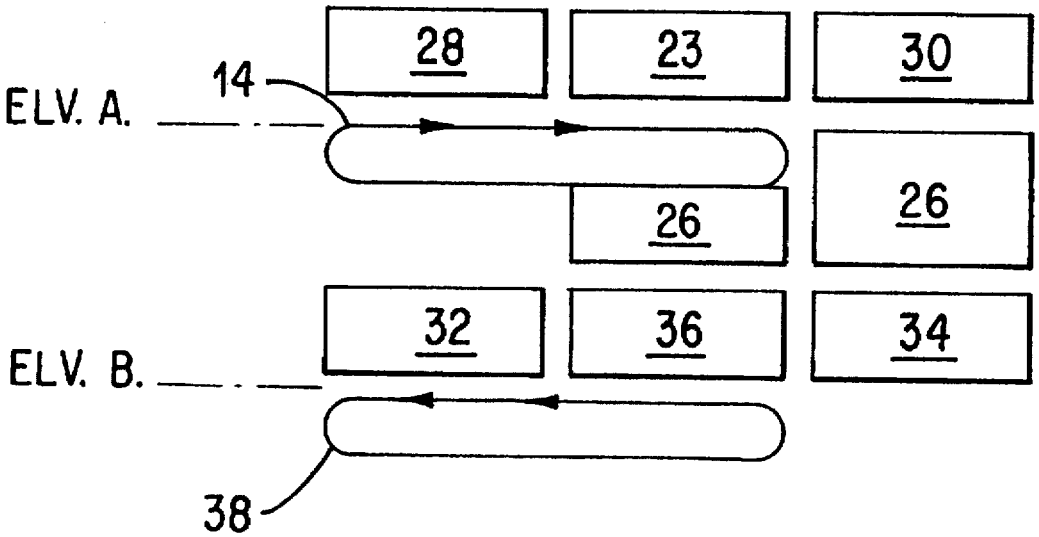
FIG. 41 is a schematic elevational view of the automated system of the present invention.

As shown in FIGS. 40 and 41, whole poultry products are supplied breast up from the queue 12 to the system 10 at a first elevational level A via product infeed conveyor 14. The poultry product passes through a weighing station 16 wherein the product and any ancillary components are weighed. The weight of the poultry product is supplied to a control system 18 which (a) calculates the proper amount of a basting fluid to be injected into the product based on product weight and (b) supplies the net product weight to a printer (not shown) for printing the weight onto a bag 19 in which the product is to be packaged.

The product is then conveyed to a receiving station 20 wherein needles 22 are inserted into the breast of the product and the calculated amount of basting fluid is injected into the product through the needles 22. If desired, means may be provided for inserting a pop-up timer into the breast of the product commercially available from Volk Enterprises of Norcross, Ga.

After the basting fluid has been introduced into the product, the product is transferred to a bagging station 23 where it is bagged and clamped to a platen 24. Positioned adjacent to the bagging station is a bag indexer 26. If desired, the system may have a plurality of bag indexers 26 which shuttle to present the proper bag 19 to the bagging station for the product currently being bagged. Prior to presentation to the bagging station, the bag 19 may be imprinted with the net weight of the product.

The platen and the bagged product 8 are then transferred to one of two chambers 28 or 30 on the same elevational level as the bagging station 23 by a platen transfer system to be described hereinafter. In the chamber 28 or 30, the bag 19 with the product positioned therein is vacuumized, sealed and trimmed. The sealed product 8 and the platen are then transferred to a second elevation level B and to one of holding stations 32 and 34. Thereafter, the sealed product 8 and the platen are conveyed to a discharge station 36 where the bag trim is removed and the sealed product is released from the platen 24 and ejected onto the product discharge conveyor 38. Any suitable mechanism (not shown) known in the art can be used to eject the sealed product from the platen 24. The empty platen 24 is then returned to the bagging station 23 for receiving another bagged product.

As can be seen from the foregoing description, the system 10 is a compact system which makes maximum use of a relatively small floor space or "footprint".

It is also totally automated, thus reducing the number of processing and packaging personnel required to accomplish the packaging of product.

It provides, in addition, a consistent, automated way of smoothing the bag neck before sealing. Reducing the wrinkles in the seal area of each bag improves the quality of the packages, because better seals are made when wrinkles in the bag neck area are reduced prior to sealing. At present, typical bag loading/sealing/vacuumizing operations include a station at which an operator must manually straighten the bag neck before the loading bag is advanced to a vacuumizing/sealing operation. This procedure is thus prone to human error, and can result in considerable variability in the degree to which the bag neck is undesirably wrinkled prior to sealing.

While the system of the present invention has been described in the context of packaging a poultry product, it may in fact be used with other products such as cheese, fresh red meat and smoked and processed. Where the product being packaged does not require the injection of a fluid, the fluid injecting system may be disabled. Similarly, any pop-up timer insertion system may be disabled.

It should also be recognized that the system of the present invention may also be used to package non-food products.

It is apparent that there has been provided in accordance with this invention an automated system and a method for vacuum packaging food products which fully satisfy the objects, means and advantages set forth hereinbefore. While the invention has been described in combination with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. An apparatus for holding a product in a bag, the bag having a bag neck, which comprises:

a) a platen comprising
- i) a first lateral edge,
- ii) a second lateral edge,
- iii) a longitudinal centerline between the first and second lateral edges,
- iv) a first half of the platen defined by the first lateral edge and the longitudinal centerline,
- v) a second half of the platen defined by the second lateral edge and the longitudinal centerline,
- vi) an upper surface, and
- vii) a lower surface; and b) a means for clamping the bag neck to the platen, the means comprising
- i) a first clamp disposed on the first half of the platen, and
- ii) a second clamp, discrete from the first clamp, disposed on the second half of the platen, wherein each of the first and second clamps are operable to clamp the bag neck to the platen, and hold the bag neck on the platen.

2. The apparatus of claim 1 wherein the first and second clamps are movable towards each other.

3. The apparatus of claim 2 wherein the first and second clamps are movable towards each other through a vertical axis of rotation.

4. The apparatus of claim 1 wherein the first and second clamps are movable towards the platen.

5. The apparatus of claim 4 wherein the first and second clamps are movable towards the platen through a horizontal axis of rotation.

6. The apparatus of claim 1 further comprising a means for accommodating a seal bar, said means disposed on the platen.

7. The apparatus of claim 6 wherein the means for accommodating a seal bar comprises a seal seat.

8. The apparatus of claim 6 wherein the means for accommodating a seal bar comprises an indent in the platen.

9. The apparatus of claim 1 further comprising a means for sealing the bag, said means disposed on the platen.

10. The apparatus of claim 9 wherein the means for sealing comprises a seal wire.

11. An apparatus for holding a product in a bag, the bag having a bag neck, which comprises:

a) a platen comprising
- i) a first lateral edge,
- ii) a second lateral edge,
- iii) a longitudinal centerline between the first and second lateral edges,
- iv) a first half of the platen defined by the first lateral edge and the longitudinal centerline,
- v) a second half of the platen defined by the second lateral edge and the longitudinal centerline,
- vi) an upper surface, and
- vii) a lower surface;

b) a means for accommodating a seal bar, said means disposed on the upper surface of the platen;

c) a means for clamping the bag neck to the means for accommodating a seal bar, the means comprising a curved clamp disposed on the first half of the platen, wherein the curved clamp is moveable through a vertical axis of rotation and operable to clamp the bag neck against the means for accommodating a seal bar, and hold the bag neck.

12. A system for holding a product in a bag, the bag having a bag neck, which comprises:

a) a platen comprising
- i) a first lateral edge,
- ii) a second lateral edge,
- iii) a longitudinal centerline between the first and second lateral edges,
- iv) a first half of the platen defined by the first lateral edge and the longitudinal centerline,
- v) a second half of the platen defined by the second lateral edge and the longitudinal centerline,
- vi) an upper surface, and
- vii) a lower surface;

b) a product in a bag, the bag having a bag neck, disposed on the platen; and c) a means for clamping the bag neck to the platen, the means comprising
- i) a first clamp disposed on the first half of the platen, and
- ii) a second clamp, discrete from the first clamp, disposed on the second half of the platen, wherein each of the first and second clamps are operable to clamp the bag neck to the platen, and hold the bag neck on the platen.

13. An system for holding a product in a bag, the bag having a bag neck, which comprises:

a) a platen comprising
- i) a first lateral edge,
- ii) a second lateral edge,
- iii) a longitudinal centerline between the first and second lateral edges,
- iv) a first half of the platen defined by the first lateral edge and the longitudinal centerline,
- v) a second half of the platen defined by the second lateral edge and the longitudinal centerline,
- vi) an upper surface, and
- vii) a lower surface;

b) a product in a bag, the bag having a bag neck, disposed on the platen;

c) a means for accommodating a seal bar, said means disposed on the upper surface of the platen; and d) a means for clamping the bag neck to the means for accommodating a seal bar, the means comprising a curved clamp disposed on the first half of the platen, wherein the curved clamp is moveable through a vertical axis of rotation and operable to clamp the bag neck against the means for accommodating a seal bar, and hold the bag neck.

14. A method for holding a product in a bag, the bag having a bag neck, which comprises:

a) providing a platen comprising
i) a first lateral edge,
ii) a second lateral edge,
iii) a longitudinal centerline between the first and second lateral edges,
iv) a first half of the platen defined by the first lateral edge and the longitudinal centerline,
v) a second half of the platen defined by the second lateral edge and the longitudinal centerline,
vii an upper surface, and
vii) a lower surface;

b) placing a product in a bag, the bag having a bag neck, on the platen;

c) providing a means for clamping the bag neck to the platen, the means comprising
i) a first clamp disposed on the first half of the platen, and
ii) a second clamp, discrete from the first clamp, disposed on the second half of the platen; and d) moving the means for clamping such that each of the clamps clamp the bag neck to the platen, and hold the bag neck on the platen.

15. A method for holding a product inside a bag, the bag having a bag neck, which comprises:

a) providing a platen comprising
i) a first lateral edge,
ii) a second lateral edge,
iii) a longitudinal centerline between the first and second lateral edges,
iv) a first half of the platen defined by the first lateral edge and the longitudinal centerline,
v) a second half of the platen defined by the second lateral edge and the longitudinal centerline,
vi) an upper surface, and
vii) a lower surface;

b) placing a product in a bag, the bag having a bag neck, on the platen;

c) providing a means for clamping the package to the platen, the means comprising a curved clamp disposed on the first half of the platen;

d) providing a means for accommodating a seal bar, said means disposed on the upper surface of the platen; and e) moving the means for clamping through a vertical axis of rotation such that the curved clamp clamps the bag neck against the means for accommodating a seal bar, and holds the bag neck.

16. A method for packaging products which comprises:

a) transporting a product to a position where a product can be loaded into a bag having a bag neck;

b) loading said product into the bag to form a package;

c) providing a platen comprising a first lateral edge, a second lateral edge, a longitudinal centerline between the first and second lateral edges, a first half of the platen defined by the first lateral edge and the longitudinal centerline, a second half of the platen defined by the second lateral edge and the longitudinal centerline, an upper surface, and a lower surface;

d) providing a means for clamping the bag neck, the means comprising a first clamp disposed on the first half of the platen, and a second clamp, discrete from the first clamp, disposed on the second half of the platen;

e) clamping the bag neck of said package to the platen at a first station by moving each of the first and second clamps to clamp the bag neck to the platen, and hold the bag neck on the platen;

f) moving said platen with said package clamped thereto to a vacuum chamber located at a second station;

g) vacuumizing said package in said vacuum chamber to form a vacuumized package; and h) sealing said vacuumized package to form a sealed package attached to said platen.

17. An automated system for packaging a product in a bag comprising:

a) a station for receiving a product to be bagged;

b) a second station at which said product is bagged;

c) means for positioning a bag having a mouth relative to said second station with the mouth of the bag being open;

d) means for transferring said product from said receiving station to said second station, said transferring means including
i) means for spreading the mouth of said bag, and
ii) means for pulling said bag over said product while said product is positioned at said second station; and e) means for clamping the mouth of the bag, said means comprising
i) a platen comprising
a first lateral edge,
a second lateral edge,
a longitudinal centerline between the first and second lateral edges,
a first half of the platen defined by the first lateral edge and the longitudinal centerline,
a second half of the platen defined by the second lateral edge and the longitudinal centerline,
an upper surface,
a lower surface,
ii) a first clamp disposed on the first half of the platen, and
iii) a second clamp, discrete from the first clamp, disposed on the second half of the platen, wherein the first and second clamps are operable to clamp the bag mouth against the platen, and hold the bag mouth on the platen.

18. An apparatus for holding a product in a bag, the bag having a bag neck, which comprises:

a) a platen comprising
i) a first lateral edge,
ii) a second lateral edge,
iii) a longitudinal centerline between the first and second lateral edges,
iv) a first half of the platen defined by the first lateral edge and the longitudinal centerline,
v) a second half of the platen defined by the second lateral edge and the longitudinal centerline,
vi) an upper surface, and
vii) a lower surface;

b) a means for clamping the bag neck to the platen, the means comprising
i) a first clamp disposed on the first half of the platen, and
ii) a second clamp, discrete from the first clamp, disposed on the second half of the platen; and c) a means for accommodating a seal bar, said means disposed on the upper surface of the platen;

wherein each of the first and second clamps are operable to clamp the bag neck against the means for accommodating a seal bar, and hold the bag neck.

* * * * *